US009421798B2

(12) United States Patent
Hayashi et al.

(10) Patent No.: US 9,421,798 B2
(45) Date of Patent: Aug. 23, 2016

(54) INK-JET RECORDING DEVICE AND INK-JET RECORDING CONTROL METHOD

(71) Applicant: CANON KABUSHIKI KAISHA, Tokyo (JP)

(72) Inventors: Aya Hayashi, Sendai (JP); Jiro Moriyama, Kawasaki (JP); Hidehiko Kanda, Yokohama (JP); Yuji Hamasaki, Kawasaki (JP); Norihiro Kawatoko, Kawasaki (JP); Toshiyuki Chikuma, Kawasaki (JP); Atsushi Sakamoto, Kawasaki (JP); Hirokazu Tanaka, Ohta-ku (JP); Masashi Hayashi, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/160,331

(22) Filed: Jan. 21, 2014

(65) Prior Publication Data

US 2014/0132657 A1 May 15, 2014

Related U.S. Application Data

(63) Continuation of application No. 13/717,341, filed on Dec. 17, 2012, which is a continuation of application No. 12/468,333, filed on May 19, 2009, now Pat. No. 8,356,875, which is a continuation of application No. 11/428,891, filed on Jul. 6, 2006, now Pat. No. 7,549,720.

(30) Foreign Application Priority Data

Jul. 8, 2005 (JP) ..... 2005-199970

(51) Int. Cl.

| | |
|---|---|
| ***B41J 29/393*** | (2006.01) |
| ***B41J 19/14*** | (2006.01) |
| ***B41J 2/21*** | (2006.01) |
| ***B41J 2/07*** | (2006.01) |

(52) U.S. Cl.

CPC *B41J 19/145* (2013.01); *B41J 2/07* (2013.01); *B41J 2/2135* (2013.01); *B41J 29/393* (2013.01); *B41J 2029/3935* (2013.01)

(58) Field of Classification Search

CPC ..... B41J 19/145; B41J 2/2135; B41J 29/393; B41J 2029/3935

See application file for complete search history.

(56) References Cited

U.S. PATENT DOCUMENTS

| | | | | |
|---|---|---|---|---|
| 6,523,926 | B1 * | 2/2003 | Mitsuzawa et al. | 347/19 |
| 2005/0057598 | A1 * | 3/2005 | Endo et al. | 347/19 |
| 2006/0158476 | A1 * | 7/2006 | Ng | B41J 2/2135 347/19 |

* cited by examiner

*Primary Examiner* — Julian Huffman

(74) *Attorney, Agent, or Firm* — Canon U.S.A., Inc. IP Division

(57) ABSTRACT

An ink-jet recording device is capable of correcting a recording position due to a leaning of a printing head and correcting of driving timing between multiple printing heads. Each nozzle row of a printing head is classified into multiple nozzle groups, and the driving timing of the nozzle groups other than the nozzle group serving as a reference of correction of the multiple nozzle groups is adjustable to correct for any leaning of the printing head. Moreover, in the event of performing the driving timing between printing heads, the driving timing of a non-reference printing head is adjustable relative to a reference printing head employed for leaning correction of multiple printing heads.

19 Claims, 29 Drawing Sheets

INK-JET RECORDING DEVICE AND INK-JET RECORDING CONTROL METHOD

CROSS-REFERENCE TO RELATED APPLICATIONS

This application is a Continuation of U.S. patent application Ser. No. 13/717,341, filed Dec. 17, 2012, which is a Continuation of U.S. patent application Ser. No. 12/468,333, filed May 19, 2009, now U.S. Pat. No. 8,356,875, which is a Continuation of U.S. patent application Ser. No. 11/428,891, filed Jul. 6, 2006, now U.S. Pat. No. 7,549,720, which claims the benefit of Japanese Application No. 2005-199970, filed Jul. 8, 2005, all of which are hereby incorporated by reference herein in their entirety.

BACKGROUND OF THE INVENTION

1. Field of the Invention

The present invention relates to an ink-jet recording device and a recording control method thereof, and particularly relates to a configuration and method for adjusting the deviation of a recording position.

2. Description of the Related Art

A common ink-jet recording device includes a recording head including multiple recording elements which are integrated and arrayed for improving recording speed, an ink discharge unit in which multiple ink discharge orifices and liquid paths are integrated, and further the multiple recording heads corresponding to multiple colors.

FIG. 1 illustrates a configuration of an ink-jet printer unit at the time of recording on a surface of a recording sheet using the above-described recording head. In the drawing, reference numeral 101 denotes ink cartridges. The ink cartridges comprise ink tanks in which ink of four colors of black, cyan, magenta, and yellow is filled respectively, and a common recording head 102. FIG. 2 illustrates a situation in which discharge orifices are arrayed on this recording head from the Z direction, wherein reference numerals 201 and 202 denote multiple discharge orifices arrayed on the recording head 102. Returning to FIG. 1 again, reference numeral 103 denotes a sheet feeding roller, which rotates in the direction of an arrow in the drawing while suppressing a recording medium P along with spurs 104, and feeds the recording medium P in the sub-scanning direction which is the Y direction as necessary. Also, reference numeral 105 denotes a feeding roller, which performs feeding of the recording medium P, and also serves as a role for suppressing the recording medium P, as with the sheet feeding roller 103 and spurs 104. Reference numeral 106 denotes a carriage which supports, records, and also moves the four ink cartridges. The carriage stands ready at a home position (h), which is a position illustrated with a dotted line in the drawing, when performing no recording, or when performing recovery work of the recording head.

The carriage 106, which is positioned at the position (home position) illustrated in the drawing prior to start of recording, upon receiving a recording start command, discharges ink from the multiple discharge orifices 201 and 202 on the recording head 102 to perform recording while moving in the main-scanning direction which is the X direction. Upon recording for forming an image being completed, i.e., the carriage 106 reaching a recording medium end portion at the opposite side of the home position, the carriage returns to the original home position, and performs one-way recording again, which repeats recording in the X direction. Also, in order to perform high-speed printing, the carriage performs bi-directional recording, which performs recording from both of the +X direction serving as the outward direction and the −X direction serving as the homeward direction.

At this time, deviation sometimes occurs at the recording position of a dot to be discharged from the respective discharge orifice rows of the four colors, or the recording position of a dot to be discharged from both of the outward direction and the homeward direction. Also, the mounting accuracy of the recording head and manufacturing irregularities cause a leaning (slanting) as to the mains-scanning direction of the discharge orifice rows. Printing in a state having such misalignment may cause a leaning dot to be printed on a recording medium. Various techniques have been proposed to perform dot recording position adjustment (register adjustment) to correct such misalignment.

FIG. 2 illustrates two recording heads, a first recording head having an ink discharge orifice row A for discharging the black ink of the four-color ink described with FIG. 1, and a second recording head having an ink discharge orifice row B for discharging the cyan ink. The recording heads are each configured so as to have the number of ink discharge orifices L=12, and recording pixel density of 600 dpi based on the interval of the ink discharge orifices of 1/600 inch. The ink discharge orifice 201 represents the ink discharge orifice n12 of the ink discharge orifice row A, and similarly, the ink discharge orifice 202 represents the ink discharge orifice n1 of the ink discharge orifice row B. Also, the amount of discharge from the recording heads is arranged such that approximately 2-pl ink droplet per one droplet can be discharged, and the discharge frequency for discharging this ink droplet in a stable manner is 30 kHz, and the discharge speed thereof is approximately 20 m/sec. The speed of the carriage mounting this recording head in the main-scanning direction is approximately 25 inch/sec when recording ink droplets with an interval of 1200 dpi in the main-scanning direction.

The deviation of a recording position between the two discharge orifice rows is adjusted using the recording head 102. FIG. 34 illustrates check patterns for obtaining an adjustment value for adjusting the deviation of a recording position between the two rows of dots to be discharged from the outward direction of the ink discharge orifice row A and ink discharge orifice row B in FIG. 2, and FIG. 4 is an enlarged view of the check patterns corresponding with 0 through +2 in FIG. 34. On the outward course recording is performed by changing discharge timing from the ink discharge orifice row B on the basis of the recording position of a dot to be discharged from the ink discharge orifice row A. An arrangement is made wherein the discharge timing is slow in the + direction, and is fast in the − direction.

The resolution which can adjust this recording positional deviation is approximately 21 μm at 1200 dpi, and can adjust the deviation of a dot recording position within a range of seven-stage patterns of −3 through +3.

With respect to the check pattern corresponding to +1 in FIG. 4, black circles to be recorded by the ink discharge orifice row A, and white circles to be recorded by the ink discharge orifice wire B are overlapped to be disguised as one line, and the amount of deviation d2 in the X direction between the two rows is approximately 0 μm.

With respect to the check pattern corresponding to +2 in FIG. 4, the recording timing of the white circles to be recorded at the ink discharge orifice row B is 1200 dpi, which is slower than the black circles to be recorded at the ink discharge orifice row A by one pixel, and the amount of deviation d1 in the X direction between the two rows is approximately 21 μm. With respect to the check pattern corresponding to 0 in FIG. 4, the recording timing of the white circles to be recorded at the ink discharge orifice row B is 1200 dpi, which is faster than the black circles to be recorded at the ink discharge orifice row A by one pixel, and the amount of deviation in the X direction between the two rows is approximately 21 μm.

FIG. 35 is a flowchart for describing the above adjustment of the deviation of a recording position between the two rows of the ink discharge orifice row A and the ink discharge orifice row B.

First, in step 4601, the check patterns illustrated in FIG. 34 are recorded for obtaining an adjustment value for adjusting the deviation of a recording position between the two rows of the ink discharge orifice row A and the ink discharge orifice row B.

In step 4602, the number +1 is selected from the check patterns illustrated in FIG. 34, which corresponds with the check pattern having the least amount of deviation in the X direction between the two rows, for obtaining an adjustment value for adjusting the deviation of a recording position between the two rows of the ink discharge orifice row A and the ink discharge orifice row B.

In step 4603, the selected number +1 or a value associated with the selected number is stored in the EEPROM of the recording device main unit (nonvolatile memory, hereinafter referred to as EEPROM) as a recording position adjustment value. Recording is performed based on this stored recording position adjustment value. Description has been made in Japanese Patent Laid-Open No. 1995-40551 regarding the above recording position adjustment.

However, an ink-jet recording device to be employed for photographic printing realizes improvement of image quality by reducing the size of droplets or the like for the sake of further improvement of image quality. Consequently, manufacturing irregularities of recording heads, and the accuracy at the time of mounting a recording head on the recording device become important factors. Particularly, there has been demand for reduced leaning printing on a recording medium, which is caused by manufacturing irregularities and leaning in the rotational direction θ due to the mounting accuracy of a recording head described in FIG. 2, and elimination of the deviation of recording position.

FIG. 7 illustrates two recording heads having a different leaning in the rotational direction θ of the ink discharge orifice rows due to manufacturing irregularities as to the recording head described with FIG. 2, or the like.

The ink discharge orifice n1 of the ink discharge orifice row A is apart from the ink discharge orifice n12 by approximately 63 μm of 3 dots at 1200 dpi in the +X direction in FIG. 7. Also, the ink discharge orifice n1 of the ink discharge orifice row B is apart from the ink discharge orifice n12 by approximately 63 μm of 3 dots at 1200 dpi in the −X direction in FIG. 7.

FIG. 10 illustrates check patterns for obtaining an adjustment value for adjusting the deviation of a recording position between the two rows of dots to be discharged from the outward direction of the ink discharge orifice row A and ink discharge orifice row B in FIG. 7, and FIG. 11 is an enlarged view of the check patterns corresponding with −3 through −1 in FIG. 10.

On the outward course recording is performed by changing the discharge timing from the ink discharge orifice row B on the basis of the recording position of a dot to be discharged from the ink discharge orifice row A. An arrangement is made wherein the discharge timing is slow in the + direction, and is fast in the − direction.

Adjustment resolution is approximately 21 μm of 1200 dpi, and can adjust the deviation of a dot recording position within a range of seven-stage patterns of −3 through +3.

With regard to −2 which corresponds with a check pattern having the least amount of deviation of seven-stage patterns of −3 through +3 in FIG. 10, the amount of deviation d2 (shown in FIG. 11) in the X direction between the two rows of the black circles to be recorded at the ink discharge orifice row A and the white circles to be recorded at the ink discharge orifice row B is approximately 63 μm.

With regard to the check pattern −1 shown in FIGS. 10 and 11, the recording timing of the white circles to be recorded at the ink discharge orifice row B is 1200 dpi, which is slower than the black circles to be recorded at the ink discharge orifice row A by one pixel, and the amount of deviation d1 in the X direction between the two rows is approximately 84 μm.

With regard to the check pattern −3 shown in FIGS. 10 and 11, the recording timing of the white circles to be recorded at the ink discharge orifice row B is 1200 dpi, which is faster than the black circles to be recorded at the ink discharge orifice row A by one pixel, and the amount of deviation in the X direction between the two rows is approximately 84 μm.

As described above, with the recording head having no leaning θ such as FIG. 2, the least amount of deviation of a recording position is 0 μm, but on the contrary, with the recording head having the leaning θ illustrated in FIG. 7, even the least amount of deviation is 63 μm, and accordingly, the deviation of a recording position can be significant, resulting in a factor for deterioration of image.

FIG. 5B shows check patterns for obtaining an adjustment value for adjusting the deviation of a recording position due to the leaning in the rotational direction θ caused in the case of recording using the recording head in FIG. 7. Check patterns A are recorded on the outward course of the ink discharge orifice row A, and FIG. 6 is an enlarged view thereof. Check patterns B are recorded on the outward course of the ink discharge orifice row B, and FIG. 8 is an enlarged view thereof.

FIG. 9 illustrates divisions of an ink discharge orifice row to be performed at the time of adjustment of leaning printing in FIG. 5B. An ink discharge orifice group 2401 corresponds to the discharge orifices n1 though n6 of the discharge orifice row A and the discharge orifices n1 though n6 of the discharge orifice row B. An ink discharge orifice group 2402 corresponds to the discharge orifices n7 though n12 of the discharge orifice row A and the discharge orifices n7 though n12 of the discharge orifice row B. An ink discharge orifice group 2403 corresponds to the discharge orifices n1 though n4 of the discharge orifice row A and the discharge orifices n1 though n4 of the discharge orifice row B. An ink discharge orifice group 2404 corresponds to the discharge orifices n5 though n8 of the discharge orifice row A and the discharge orifices n5 though n8 of the discharge orifice row B. An ink discharge orifice group 2405 corresponds to the discharge orifices n9 though n12 of the discharge orifice row A and the discharge orifices n9 though n12 of the discharge orifice row B. Also, let us say that the reference is the ink discharge orifice group 2403 corresponding to the ink discharge orifices n1 through n4 of each ink discharge orifice row. In the case of dividing an ink discharge orifice row into two, recording is performed on the outward course by changing the discharge timing of the ink discharge orifice group 2402 as to the ink discharge orifice group 2401 including the ink discharge orifice group 2403 serving as the reference. An arrangement is made such that the discharge timing is slow in the + direction, and is fast in the − direction.

In the case of dividing an ink discharge orifice row into three, recording is performed on the outward course by changing the discharge timing of the ink discharge orifice group 2404 as to the ink discharge orifice group 2403 serving as the reference. Similarly, recording is performed by further changing the discharge timing of the ink discharge orifice group 2405 as to the ink discharge orifice group 2403 serving as the reference. An arrangement is made such that the discharge timing is slow in the + direction, and is fast in the − direction.

Number-of-divisions adjustment resolution is approximately 21 μm of 1200 dpi, and can adjust the deviation of a dot recording position within a range of five-stage patterns of −2 through +2.

With respect to the pattern corresponding to 0 illustrated in FIG. 6, recording is performed by setting the discharge timing from all of the ink discharge orifices to the same discharge timing without dividing the ink discharge orifice row A, and the amount of deviation of a recording position is approximately 84 μm. With respect to the pattern corresponding to +1 in FIG. 6, the ink discharge orifice row A is divided into two, the recording timing at the ink discharge orifice group 2402 is 1200 dpi, which is slower than the ink discharge orifice group 2401 including the ink discharge orifice group 2403 serving as the reference by one pixel, and the amount of deviation d4 of the recording position of the ink discharge orifice row A is approximately 63 μm. With respect to the pattern corresponding to +2 in FIG. 6, the ink discharge orifice row A is divided into three, the recording timing at the ink discharge orifice group 2404 is 1200 dpi, which is slower than the ink discharge orifice group 2403 serving as the reference by one pixel, and further the recording timing at the ink discharge orifice group 2405 is 1200 dpi, which is slower than the ink discharge orifice group 2403 serving as the reference by two pixels. The amount of deviation d5 of the recoding position of the ink discharge orifice row A at this time is approximately 42 μm. With respect to the pattern corresponding to −1 in FIG. 6, the ink discharge orifice row A is divided into two, the recording timing at the ink discharge orifice group 2402 is 1200 dpi, which is faster than the ink discharge orifice group 2401 including the ink discharge orifice group 2403 serving as the reference by one pixel, and the amount of deviation d2 of the recording position of the ink discharge orifice row A is approximately 105 μm. With respect to the pattern corresponding to −2 in FIG. 6, the ink discharge orifice row A is divided into three, the recording timing at the ink discharge orifice group 2404 is 1200 dpi, which is faster than the ink discharge orifice group 2403 serving as the reference by one pixel, and further the recording timing at the ink discharge orifice group 2405 is 1200 dpi, which is faster than the ink discharge orifice group 2403 serving as the reference by two pixels. The amount of deviation d2 of the recoding position of the ink discharge orifice row A at this time is approximately 126 μm.

With respect to the pattern corresponding to 0 illustrated in FIG. 8, recording is performed by setting the discharge timing from all of the ink discharge orifices to the same discharge timing without dividing the ink discharge orifice row B, and the amount of deviation d3 of the recording position is approximately 84 μm. With respect to the pattern corresponding to +1 in FIG. 8, the ink discharge orifice row B is divided into two, the recording timing at the ink discharge orifice group 2402 is 1200 dpi, which is slower than the ink discharge orifice group 2401 including the ink discharge orifice group 2403 serving as the reference by one pixel, and the amount of deviation d4 of the recording position of the ink discharge orifice row B is approximately 105 μm. With respect to the pattern corresponding to +2 in FIG. 8, the ink discharge orifice row B is divided into three, the recording timing at the ink discharge orifice group 2404 is slower than the ink discharge orifice group 2403 serving as the reference, and further the recording timing at the ink discharge orifice group 2405 is 1200 dpi, which is slower than the ink discharge orifice group 2403 in FIG. 24 serving as the reference by two pixels. The amount of deviation d5 of the recoding position of the ink discharge orifice row B at this time is approximately 126 μm. With respect to the pattern corresponding to −1 in FIG. 8, the ink discharge orifice row B is divided into two, the recording timing at the ink discharge orifice group 2402 is 1200 dpi, which is faster than the ink discharge orifice group 2401 serving as the reference by one pixel, and the amount of deviation d2 of the recording position of the ink discharge orifice row B is approximately 63 μm. With respect to the pattern corresponding to −2 in FIG. 8, the ink discharge orifice row B is divided into three, the recording timing at the ink discharge orifice group 2404 is 1200 dpi, which is faster than the ink discharge orifice group 2403 serving as the reference by one pixel, and further the recording timing at the ink discharge orifice group 2405 is 1200 dpi, which is faster than the ink discharge orifice group 2403 in FIG. 24 serving as the reference by two pixels. The amount of deviation d1 of the recoding position of the ink discharge orifice row B at this time is approximately 42 μm.

FIG. 15A is a flowchart for describing adjustment of a recording positional deviation within an ink discharge orifice row using the recording head in FIG. 7. First, in step 1501, the check patterns A are recorded for obtaining an adjustment value for adjusting a recording positional deviation in the θ direction within the ink discharge orifice row A.

In step 1502, the number of +2 is selected wherein the amount of deviation at the recording position is the least, i.e., a small deviation as to the main-scanning direction from the check patterns A in FIG. 5A for obtaining an adjustment value for adjusting a recording positional deviation in the θ direction within the ink discharge orifice row A. In step 1503, the selected +2 is stored in the EEPROM of the recording device main unit as a recording position adjustment value within the ink discharge orifice row A. In step 1504, the check patterns B are recorded for obtaining an adjustment value for adjusting a recording positional deviation in the θ direction within the ink discharge orifice row B. In step 1505, the number of −2 is selected wherein the amount of deviation at the recording position is the least, i.e., a small deviation as to the main-scanning direction from the check patterns B in FIG. 5A for obtaining an adjustment value for adjusting a recording positional deviation in the θ direction within the ink discharge orifice row B. In step 1506, the selected −2 is stored in the EEPROM of the recording device main unit as a recording position adjustment value within the ink discharge orifice row B.

FIG. 12 is check patterns for obtaining an adjustment value for adjusting a recording positional deviation between two ink discharge orifice rows recorded on the outward course upon which the recording position adjustment values stored in the EEPROM within the ink discharge orifice row A and within the ink discharge orifice row B in FIG. 7 are reflected. FIG. 13 is an enlarged view of 0 through +2 in FIG. 12.

On the outward course recording is performed by changing the discharge timing from the ink discharge orifice row B on the basis of the recording position of a dot to be discharged from the ink discharge orifice row A. An arrangement is made wherein the discharge timing is slow in the + direction, and is fast in the − direction.

Adjustment resolution is approximately 21 μm of 1200 dpi, and can adjust the deviation of a dot recording position within a range of seven-stage patterns of −3 through +3.

With respect to the pattern corresponding to +1 illustrated in FIG. 13, black circles to be recorded by the ink discharge orifice row A, and white circles to be recorded by the ink discharge orifice wire B are overlapped, and the amount of deviation d2 in the X direction between the two rows is approximately 42 μm. With respect to the pattern corresponding to +2 in FIG. 13, the recording timing of the white circles to be recorded at the ink discharge orifice row B is 1200 dpi, which is slower than the black circles to be recorded at the ink discharge orifice row A by one pixel, and the amount of deviation d1 in the X direction between the two rows is approximately 63 μm. With respect to the pattern corresponding to 0 in FIG. 13, the recording timing of the white circles to be recorded at the ink discharge orifice row B is 1200 dpi, which is faster than the black circles to be recorded at the ink discharge orifice row A by one pixel, and the amount of deviation d3 in the X direction between the two rows is approximately 63 μm.

Now, FIG. 15B is a flowchart for describing adjustment of a recording positional deviation between ink discharge orifice rows using the recording head in FIG. 7. In step 1507, the check patterns C in FIG. 12 are recorded for obtaining an adjustment value for adjusting a recording positional deviation between the two rows of the ink discharge orifice row A and the ink discharge orifice row B in a state in which the recording positions within the respective ink discharge orifice rows are adjusted based on the recording position adjustment values within the ink discharge orifice row A and the recording position adjustment values within the ink discharge orifice row B for adjusting the recording positions in the θ direction. In step 1508, the number of +1 wherein the amount of deviation in the X direction between the two rows is the least is selected from the check patterns C in FIG. 12 for obtaining an adjustment value for adjusting the deviation of a recording position between the two rows of the ink discharge orifice row A and the ink discharge orifice row B.

In step 1509, the selected +1 is stored in the EEPROM of the recording device main unit as a recording position adjustment value between the two rows of the ink discharge orifice row A and the ink discharge orifice row B. Recording is performed based on this stored recording position adjustment value. As described above, deterioration of an image due to a recording positional deviation caused by manufacturing irregularities of recording devices and recording heads, and mounting irregularities of a recording head can be reduced.

However, with this method, first, it is necessary to obtain a recording position adjustment value for adjusting a recording positional deviation within the ink discharge orifice row for each ink discharge orifice row. Next, in a state in which a recording positional deviation within the ink discharge orifice row is adjusted using the adjustment value, a recording positional deviation between ink discharge orifice rows is adjusted. Accordingly, it is necessary to perform recording position adjustment in two stages, which causes very poor usability.

SUMMARY OF THE INVENTION

An embodiment of the present invention is provided to address the above problems, and provide a recording device for preventing an image from deterioration due to the recording positional deviation of a recording dot caused by manufacturing irregularities of recording devices and recording heads, and mounting accuracy of a recording head, and an adjustment method of a recording positional deviation at the time of recording.

Further, an embodiment of the present invention provides a method for obtaining an adjustment value which can adjust a recording positional deviation between ink discharge orifice rows without reflecting the recording position adjustment values within the respective discharge orifice rows.

According to an aspect of the present invention, an embodiment is directed to an ink-jet recording device capable of discharging ink to perform recording on a recording medium while main-scanning at least one recording head. The at least one recording head includes at least two ink discharge orifice rows arrayed in a direction different from a direction of the main-scanning. The ink-jet recording device includes a first adjustment unit to adjust driving timing within each respective ink discharge orifice row by classifying each of the respective ink discharge orifice rows into at least two ink discharge orifice groups, and controlling timing for discharging ink from at least one of ink discharge orifices or at least one of the ink discharge orifice groups in the main-scanning direction relative to an ink discharge orifice or one of the ink discharge orifice groups serving as a reference. The ink-jet recording device further includes a second adjustment unit to adjust driving timing between the ink discharge orifice rows by controlling timing for discharging ink from at least one of the ink discharge orifice rows in the main-scanning direction relative to one of the ink discharge orifice rows serving as a reference of the multiple ink discharge orifice rows. An adjustment value used by the second adjustment unit is obtained by controlling timing for discharging from at least one of the ink discharge orifice rows using at least a part of the ink discharge orifice or the ink discharge orifice group serving as the reference employed by the first adjustment unit.

According to an embodiment of the present invention, image deterioration due to a recording positional deviation caused by manufacturing irregularities of recording devices and recording heads, and mounting accuracy of a recording head can be reduced.

According to another aspect of the present invention, an embodiment is directed to a method capable of discharging ink to perform recording on a recording medium while main-scanning at least one recording head. The at least one recording head includes at least two ink discharge orifice rows arrayed in a direction different from a direction of the main-scanning. The method includes first adjusting driving timing within each respective ink discharge orifice row by classifying each of the respective ink discharge orifice rows into at least two ink discharge orifice groups, and controlling timing for discharging ink from at least one of ink discharge orifices or at least one of the ink discharge orifice groups in the main-scanning direction relative to an ink discharge orifice or one of the ink discharge orifice groups serving as a reference. The method further includes second adjusting driving timing between the ink discharge orifice rows by controlling timing for discharging ink from at least one of the ink discharge orifice rows in the main-scanning direction relative to one of the ink discharge orifice rows serving as a reference of the multiple ink discharge orifice rows. An adjustment value used for the second adjusting is obtained by controlling timing for discharging from at least one of the ink discharge orifice rows using at least a part of the ink discharge orifice or the ink discharge orifice group serving as the reference for the first adjusting.

Further features of the present invention will become apparent from the following description of exemplary embodiments with reference to the attached drawings. It is noted that the references to "an" or "one" embodiment of this disclosure are not necessarily directed to the same embodiment, and such references mean at least one.

DESCRIPTION OF THE EMBODIMENTS

First Exemplary Embodiment

Figure 1:
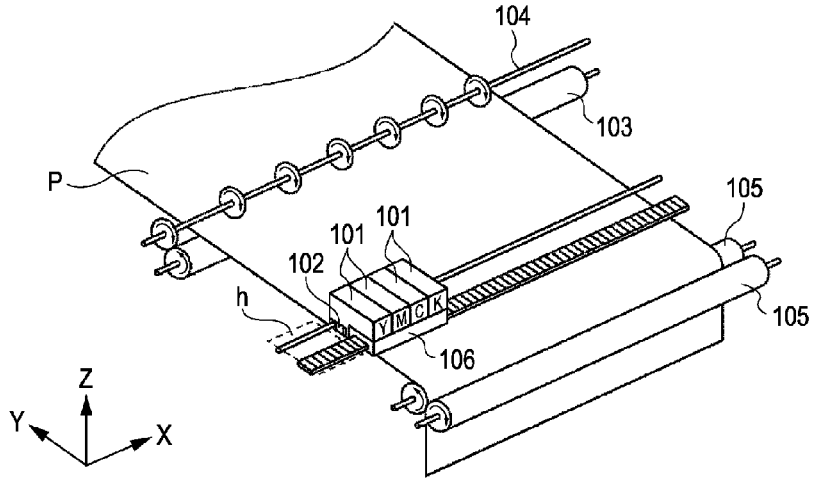
FIG. 1 is a schematic explanatory diagram of an ink-jet recording device to which an embodiment of the present invention can be applied.
Figure 3:
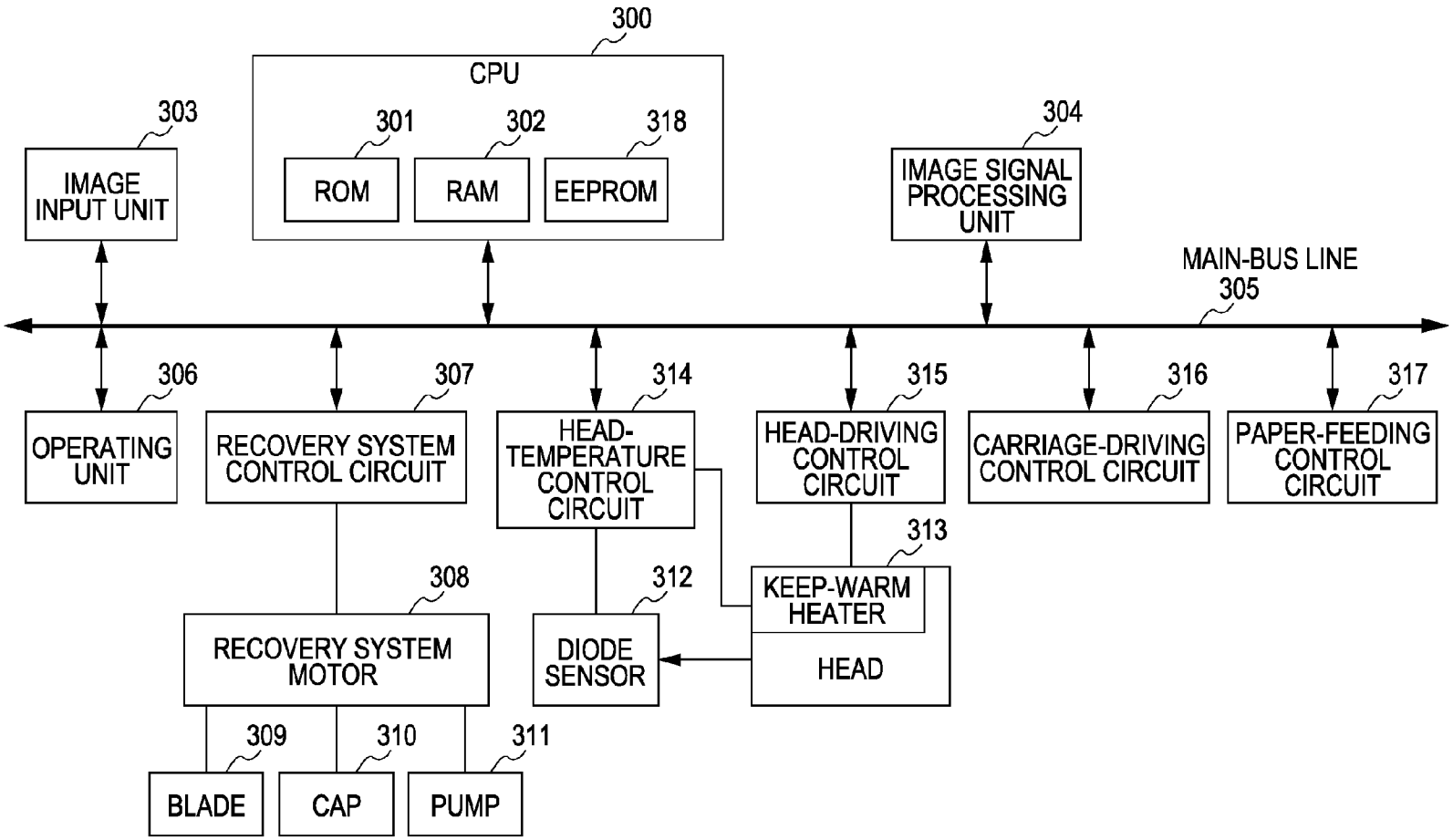
FIG. 3 is a block diagram illustrating the control configuration of an ink-jet recording device to which an embodiment of the present invention can be applied.
Figure 4:
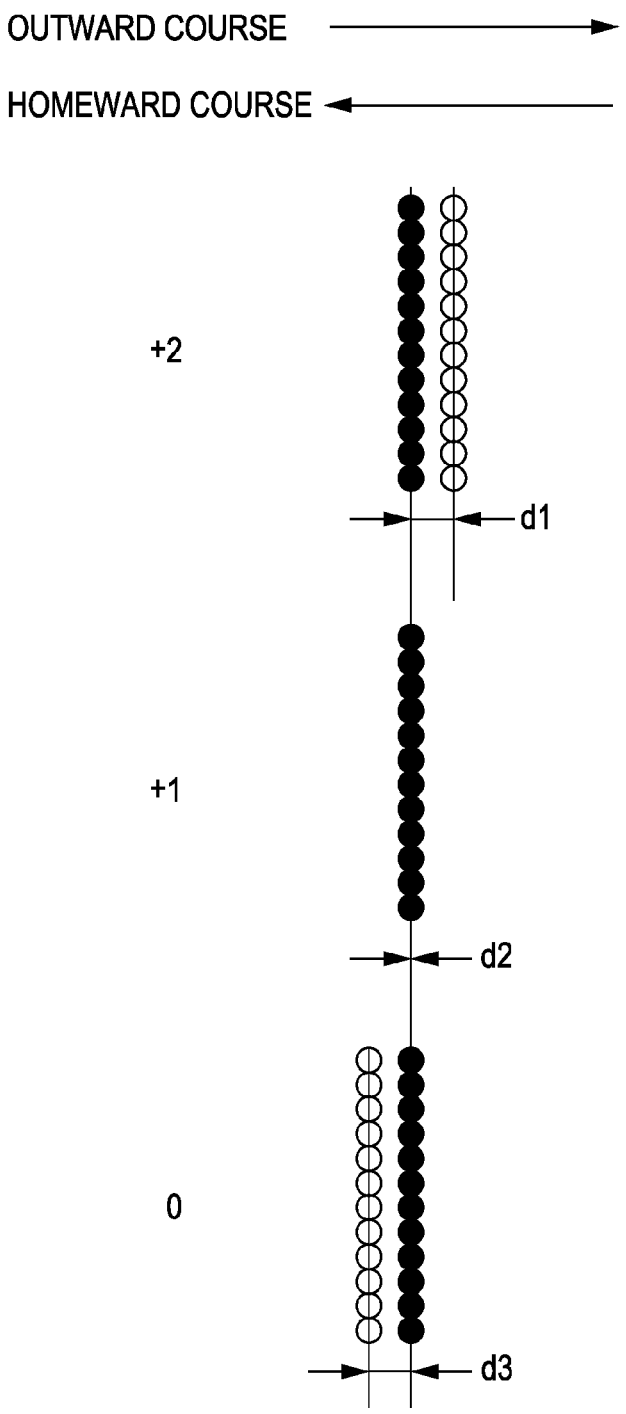
FIG. 4 is a diagram showing an enlarged view of a part of the conventional check patterns in FIG. 34.

FIG. 3 is a block diagram illustrating a control configuration of an ink-jet recording device according to an embodiment of the present invention. Let us say that the mechanical configuration of the ink-jet recording device according to the present embodiment is the same as that illustrated in FIG. 1. The control configuration is classified broadly into a processing section for controlling printing data and firmware, such as an image input unit 303, an image signal processing unit 304 corresponding thereto, and a central processing unit CPU 300, and hardware system processing section, such as an operating unit 306, a recovery system control circuit 307, a head-temperature control circuit 314, a head-driving control circuit 315, a carriage-driving control circuit 316 toward the main-scanning direction, and a sheet feeding control circuit 317 toward the sub-scanning direction, which access to a main-bus line 305 respectively. The CPU 300 generally includes ROM (Read Only Memory) 301, RAM (memory accessible by an arbitrary address) 302, and EEPROM 318, and drives a recording head 313 to perform recording by providing appropriate recording conditions as to input information. Also, a program for executing the recovery timing chart of a recording head is stored in the RAM 302 beforehand, which provides recovery conditions such as a spare discharge condition and so forth to the recovery system control circuit 307, recording head, keep-warm heater, and so forth as necessary. A recovery system motor 308 drives a recording head 313 such as described above, and a cleaning blade 309 which comes into contact therewith and provides space therebetween, a cap 310, and a suction pump 311. The head-driving control circuit 315 executes the driving conditions of an ink discharge electric thermal conversion member of the recording head 313, and controls the recording head 313 to perform ordinary spare discharge and ink discharge for recording. In addition, the head-driving control circuit 315 executes adjustment of the driving timing of the head under the control of the CPU 300. On the other hand, with a board where the electric thermal conversion member for ink discharge of the recording head 313 is provided, a keep-warm heater is sometimes provided, which can subject the ink temperature within the recording head to heat adjustment so as to be set to the desired setting temperature. Also, a diode sensor 312 is provided on the board, which is for measuring the substantial ink temperature within the recording head. Similarly, the diode sensor 312 may be provided outside the board, or may be provided in the vicinity of the recording head.

Figure 5A:
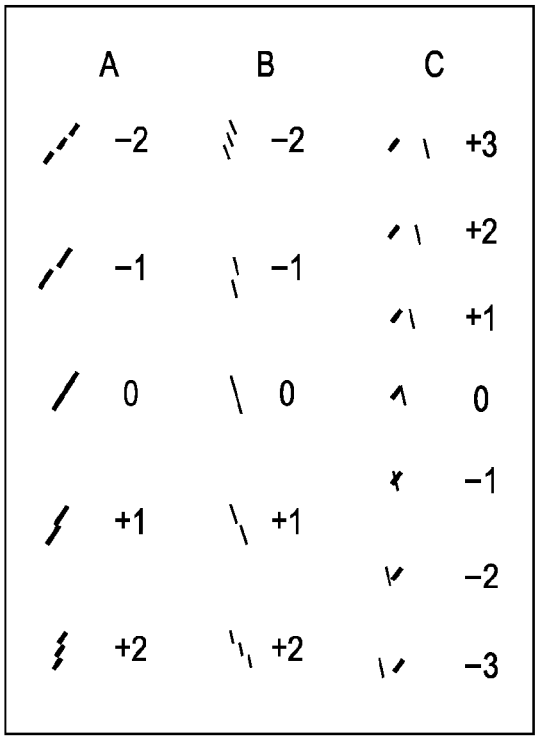
FIG. 5A is a diagram illustrating check patterns for adjusting a recording positional deviation according to a first embodiment.
Figure 5B:
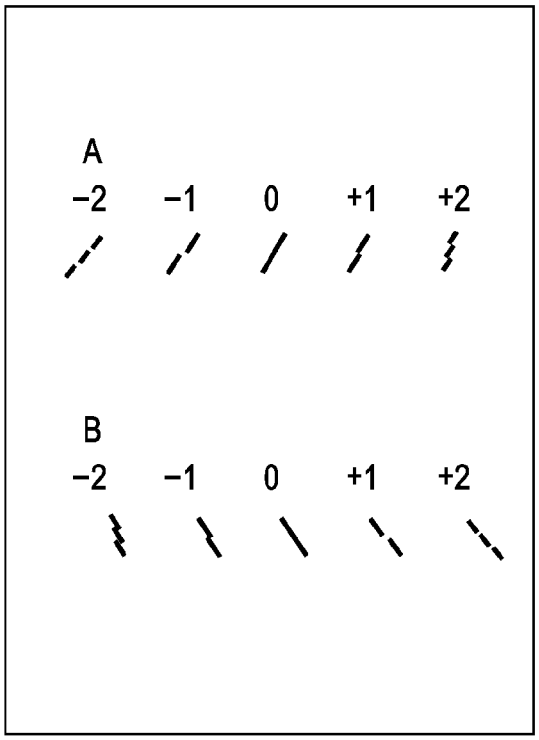
FIG. 5B shows check patterns for adjusting a recoding position deviation due to the leaning in the rotational direction θ.
Figure 7:
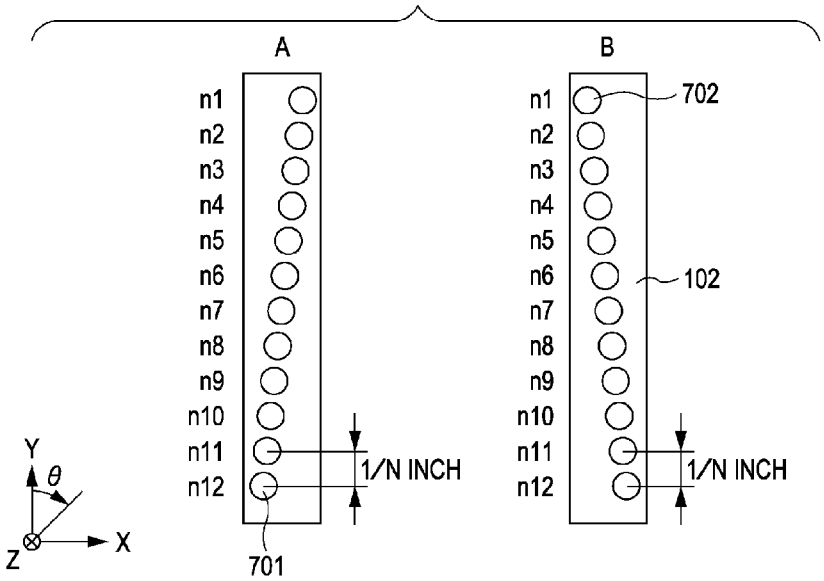
FIG. 7 is a diagram schematically illustrating ink discharge orifice rows in a recording head to which the first embodiment can be applied.

With the first embodiment of the present invention, description will be made regarding a case in which two recording heads each having one of the ink discharge orifice rows illustrated in FIG. 7 are employed. FIGS. 5A and 5B are check patterns for obtaining an adjustment value for adjusting the deviation of a recording position due to the leaning in the rotational direction θ caused in the case of recording using the recording head in FIG. 7, and the deviation of a recording position between the two rows of the ink discharge orifice row A and the ink discharge orifice row B.

Figure 6:
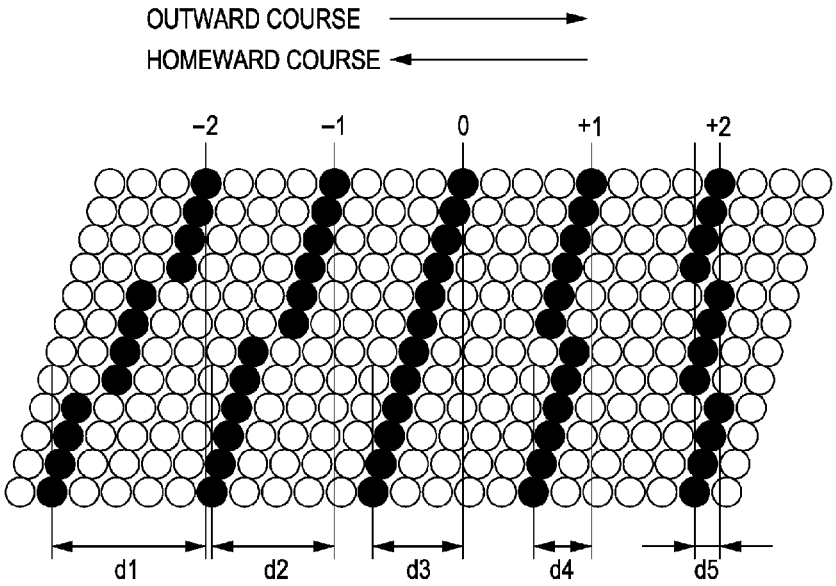
FIG. 6 is a diagram showing an enlarged view of a part of dots recorded on the outward course of an ink discharge orifice row A.

Also, the check patterns A in FIG. 5A are recorded on the outward course of the ink discharge orifice row A, and are the same patterns as +2 through −2 of the check patterns A in FIG. 5B, and FIG. 6 is an enlarged view thereof.

Figure 8:
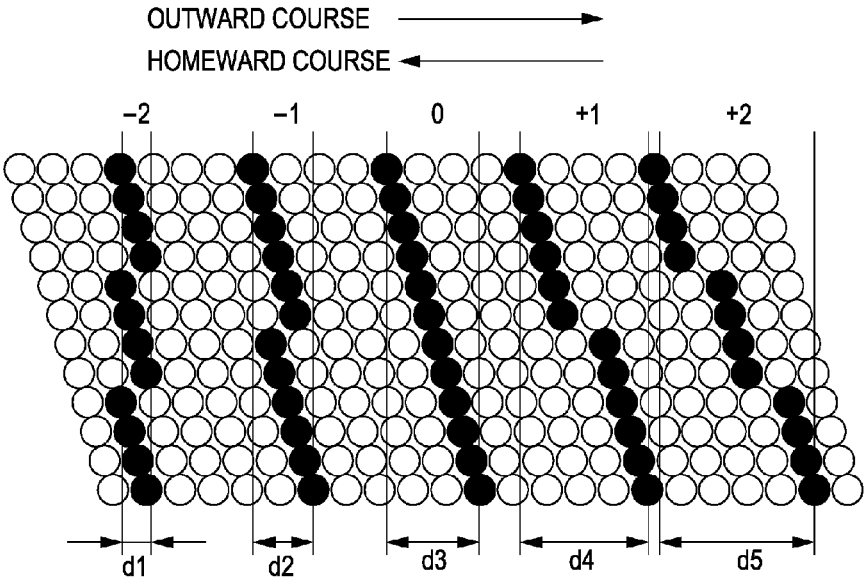
FIG. 8 is a diagram showing an enlarged view of a part of dots recorded on the outward course of an ink discharge orifice row B.

Also, the check patterns B in FIG. 5A are recorded on the outward course of the ink discharge orifice row B, and are the same patterns as +2 through −2 of the check patterns B in FIG. 5B, and FIG. 8 is an enlarged view thereof.

The adjustment resolution of the check patterns A and the check patterns B is approximately 21 μm of 1200 dpi, and can adjust the deviation of a dot recording position within a range of five-stage patterns of −2 through +2.

Figure 21:
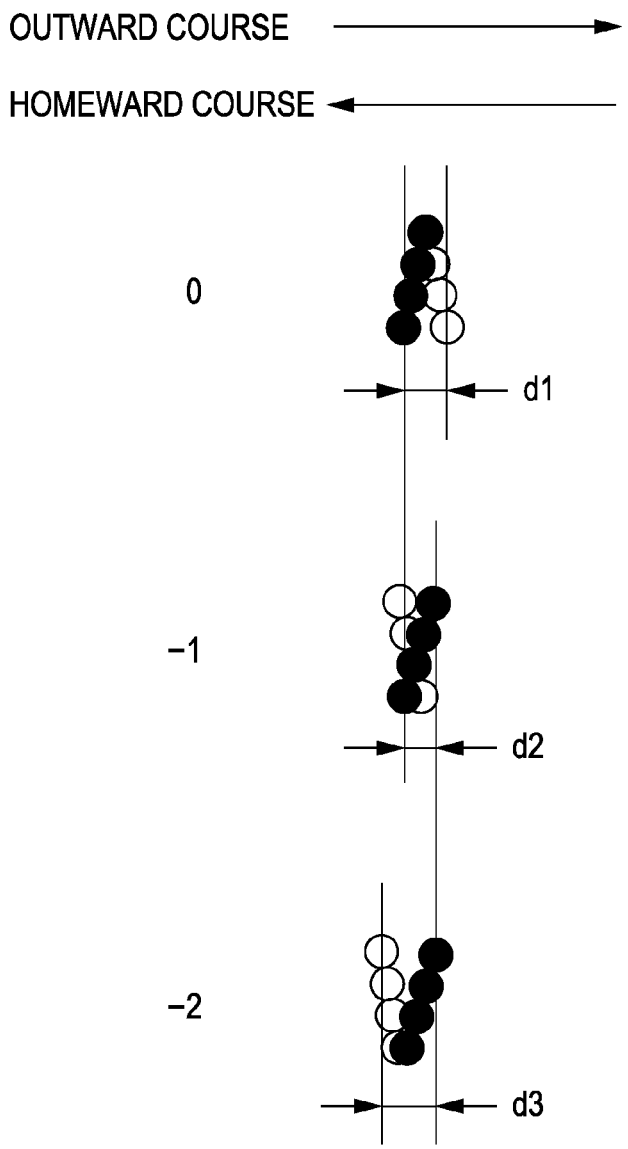
FIG. 21 is a diagram illustrating an enlarged view of a part of FIG. 5A.

The check patterns C in FIG. 5A are check patterns recorded on the outward course of the ink discharge orifice group 2403 serving as the reference to be employed for adjustment of the deviation of a recording position in the θ direction within the ink discharge orifice row A, and the ink discharge orifice group 2403 serving as the reference to be employed for adjustment of the deviation of a recording position in the θ direction within the ink discharge orifice row B. FIG. 21 is an enlarged view of −2 through 0 of the check patterns C in FIG. 5A. Recording is performed on the outward course by changing the discharge timing from the ink discharge orifice group 2403 serving as the reference to be employed for adjustment of the deviation of a recording position in the θ direction within the ink discharge orifice row B on the basis of the recording position of a dot to be discharged from the ink discharge orifice group 2403 serving as the reference to be employed for adjustment of the deviation in the θ direction within the ink discharge orifice row A. An arrangement is made wherein the discharge timing is slow in the + direction, and is fast in the − direction.

With respect to the pattern corresponding to −1 illustrated in FIG. 21, the black circles to be recorded at the ink discharge orifice group 2403 serving as the reference to be employed for adjustment of the deviation of a recording position in the θ direction within the ink discharge orifice row A, and the white circles to be recorded at the ink discharge orifice group 2403 serving as the reference to be employed for adjustment of the deviation of a recording position in the θ direction within the ink discharge orifice row B, are overlapped. The amount of deviation d2 in the X direction between the two rows is approximately 21 μm. With respect to the pattern corresponding to 0 in FIG. 21, the recording timing of the white circles recorded at the ink discharge orifice group 2403 serving as the reference to be employed for adjustment of the deviation of a recording position in the θ direction within the ink discharge orifice row B is 1200 dpi, which is slower than the black circles recorded at the ink discharge orifice group 2403 serving as the reference to be employed for adjustment of the deviation of a recording position in the θ direction within the ink discharge orifice row A by one pixel. The amount of deviation d1 in the X direction between the two rows is approximately 42 μm. With respect to the pattern corresponding to −2 in FIG. 21, the recording timing of the white circles recorded at the ink discharge orifice group 2403 serving as the reference to be employed for adjustment of the deviation of a recording position in the θ direction within the ink discharge orifice row B is 1200 dpi, which is faster than the black circles recorded at the ink discharge orifice group 2403 serving as the reference to be employed for adjustment of the deviation of a recording position in the θ direction within the ink discharge orifice row A by one pixel. The amount of deviation d3 in the X direction between the two rows is approximately 42 μm. The adjustment resolution of the check patterns C is approximately 21 μm of 1200 dpi, and can adjust the deviation of a dot recording position within a range of seven-stage patterns of −3 through +3.

Figure 14:
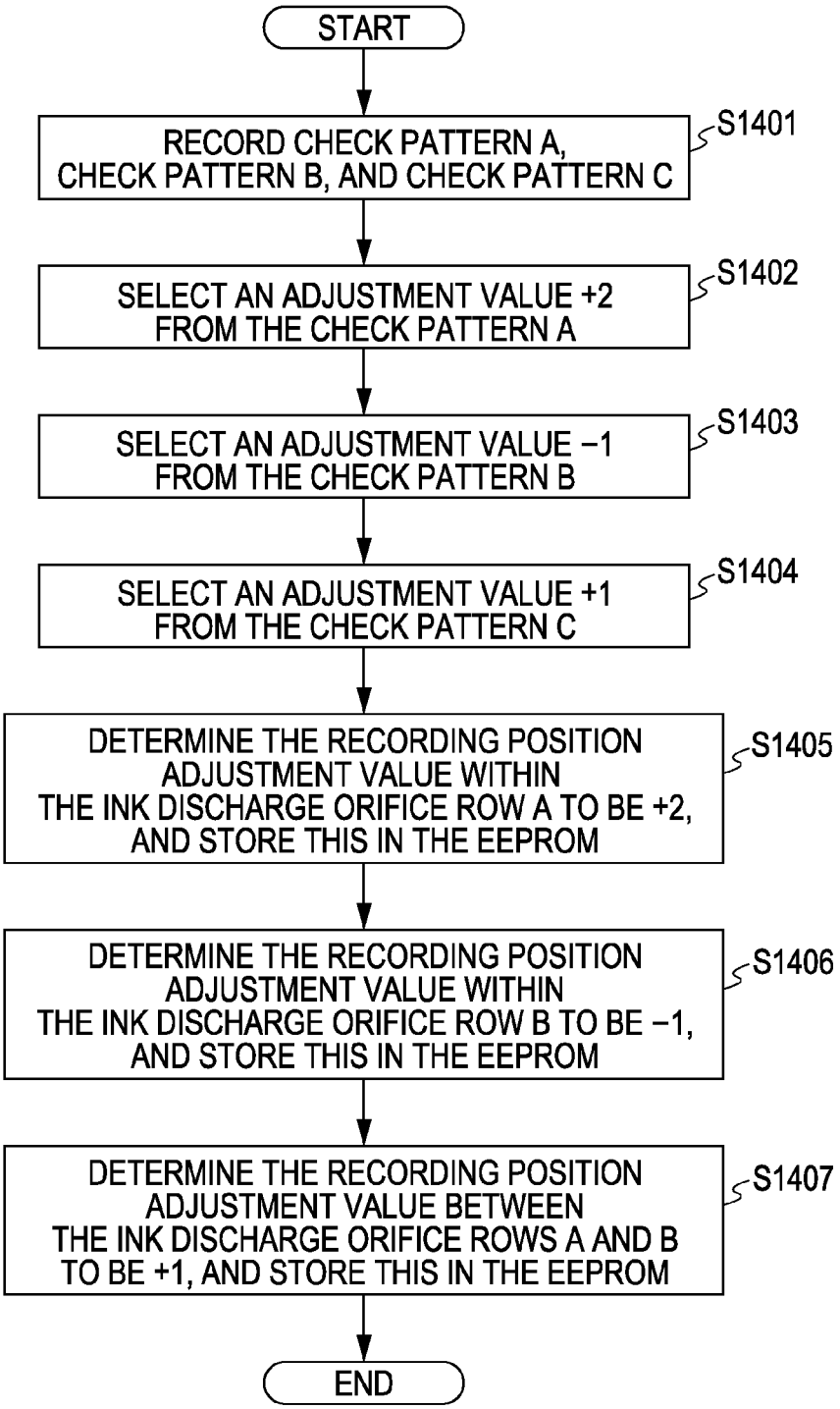
FIG. 14 is a flowchart for describing the first embodiment.
Figure 15A:
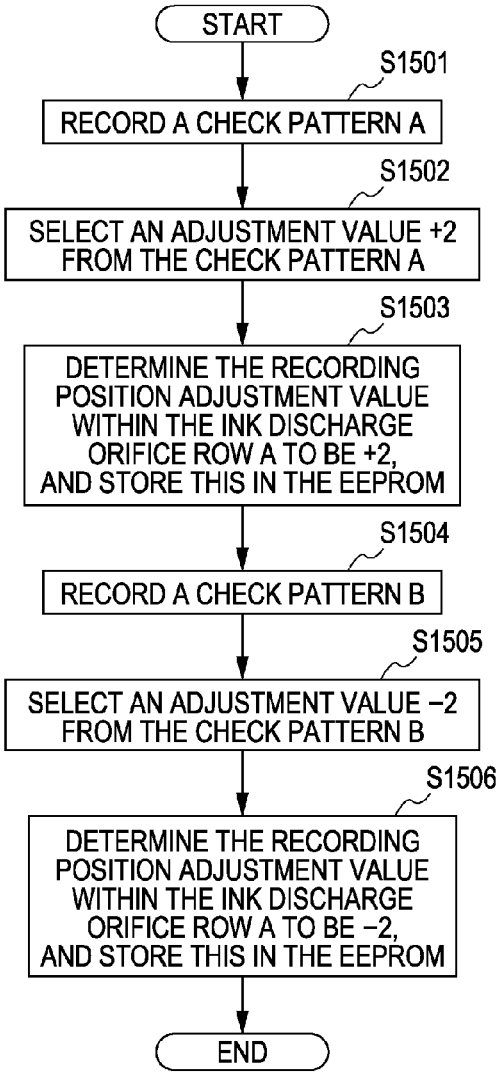
FIG. 15A is an adjustment flowchart of a recording positional deviation within an ink discharge orifice row employing the recording head in FIG. 7.
Figure 15B:
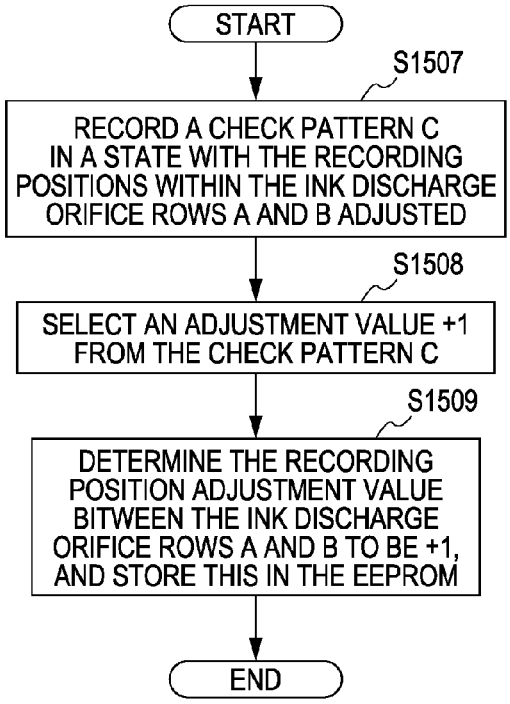
FIG. 15B is an adjustment flowchart of a recording positional deviation between ink discharge orifice rows employing the recording head in FIG. 7.

FIG. 14 is a flowchart according to the present embodiment for describing adjustment of a recording positional deviation using the recording head in FIG. 7.

First, in step 1401, the check patterns A for obtaining an adjustment value for adjusting the deviation of a recording position in the θ direction within the ink discharge orifice row A, and the check patterns B for obtaining an adjustment value for adjusting the deviation of a recording position in the θ direction within the ink discharge orifice row B in FIG. 5A are recorded. Further, the check patterns C for obtaining an adjustment value for adjusting the deviation of a recording position between the two rows of the ink discharge orifice row A and the ink discharge orifice row B are recorded. In step 1402, the number +2 is selected from the check patterns A in FIG. 5A, which corresponds with the check pattern having the least amount of deviation at the recording position, for obtaining an adjustment value for adjusting a recording positional deviation in the θ direction within the ink discharge orifice row A. In step 1403, the number −2 is selected from the check patterns B in FIG. 5A, which corresponds with the check pattern having the least amount of deviation at the recording position, for obtaining an adjustment value for adjusting a recording positional deviation in the θ direction within the ink discharge orifice row B. In step 1404, the number +1 is selected from the check patterns C in FIG. 5A, which corresponds with the check pattern having the least amount of deviation, for obtaining an adjustment value for adjusting the deviation of a recording position between the two rows of the ink discharge orifice row A and the ink discharge orifice row B. In step 1405, the selected number +2 or a value associated with the selected number is stored in the EEPROM of the recording device main unit as a recording position adjustment value within the ink discharge orifice row A. In step 1406, the selected number −2 or a value associated with the selected number is stored in the EEPROM of the recording device main unit as a recording position adjustment value within the ink discharge orifice row B. In step 1407, the selected number +1 or a value associated with the selected number is stored in the EEPROM of the recording device main unit as a recording position adjustment value between the two rows of the ink discharge orifice row A and the ink discharge orifice row B.

Recording is performed using these stored recording position adjustment values.

As described above, with the recording head in which the ink discharge orifice rows having the leaning θ in the rotational direction, a conventional method for obtaining an adjustment value for adjusting the deviation of a recording position between the ink discharge orifice rows exhibits the least amount of a recording positional deviation of 63 μm. On the contrary, upon employing the above method described with the present embodiment for obtaining an adjustment value for adjusting a recording positional deviation, the least amount of a recording positional deviation becomes 21 μm, whereby a recording positional deviation can be reduced. Thus, the present embodiment can provide the method for obtaining an adjustment value for adjusting the deviation of a recording position between the ink discharge orifice rows, which can reduce image deterioration due to the recording positional deviation of a recoding dot caused by manufacturing irregularities of recording devices and recording heads, and mounting irregularities of a recording head, and further without reflecting the recording position adjustment values within the respective ink discharge orifice rows. With the present embodiment, description has been made regarding the case in which the two recording heads each made up the one ink discharge orifice row illustrated in FIG. 7 are provided, the ink discharge orifice row A discharges black ink, and the ink discharge orifice row B discharges cyan ink. However, the present invention is not restricted to this. The present invention can be applied to the case of discharging different ink such as magenta, yellow, and so forth from the respective ink discharge orifice rows. Also, with the present embodiment, description has been made using ink droplets of approximately 2 pl, but the present invention is not restricted to this. Ink droplets may be greater than approximately 2 pl, or may be smaller, and further, may be changed in size for each color or each discharge orifice row.

Variable techniques are available for obtaining an adjustment value according to the present embodiment. A user can manually input a selected value directly to the ink-jet recording device main unit via a PC printer driver. Check patterns are scanned using an optical sensor or the like, a pattern in which the amount of a recording positional deviation is the least is detected, and the detected pattern value can be input automatically. Also, the method has been described for recording all of the check patterns by changing the discharge timing, but includes the case of creating check patterns based on a plurality of recording data prepared beforehand. The above check patterns may be created within the recording device, or may be created within a host device which generates recording data. Also, description has been made regarding the method for recording all of the patterns on the outward course, but the method is not restricted to this, the case of recording the check patterns on the homeward course is also included. Also, with the present embodiment, the vertical ruled line patterns using all of the ink discharge orifices of which timing for discharging ink from the other ink discharge orifice groups is changed as to the ink discharge orifice group serving as the reference to be employed by an adjustment unit within the ink discharge orifice rows at the time of recording image data have been employed as check patterns for obtaining an adjustment value for adjusting the deviation of a recording position in the θ direction within each of the ink discharge orifice rows, and an adjustment value has been obtained from the amount of a recording positional deviation in the main-scanning direction, but the check patterns are not restricted to these. Other check patterns may be employed, which can determine the amount of a recording positional deviation in the main-scanning direction between the recording position from the ink discharge orifice at the upstream side and the recording position from the ink discharge orifice at the downstream side of an ink discharge orifice row.

Also, with the present embodiment, the vertical ruled line patterns from the respective ink discharge orifice rows using the ink discharge orifice group serving as the reference to be employed by the adjustment unit within the ink discharge orifice rows at the time of recording image data have been employed as check patterns for obtaining an adjustment value for adjusting the deviation of a recording position between ink discharge orifice rows, and an adjustment value has been obtained from the amount of a recording positional deviation in the main-scanning direction of each of the vertical ruled line patterns, but the check patterns are not restricted to these. Other check patterns may be employed, which can determine the amount of a recording position in the main-scanning direction of the respective ink discharge orifice rows using at least a part of the ink discharge orifice group serving as the reference to be employed by the adjustment unit within the ink discharge orifice rows at the time of recording image data.

Figure 2:
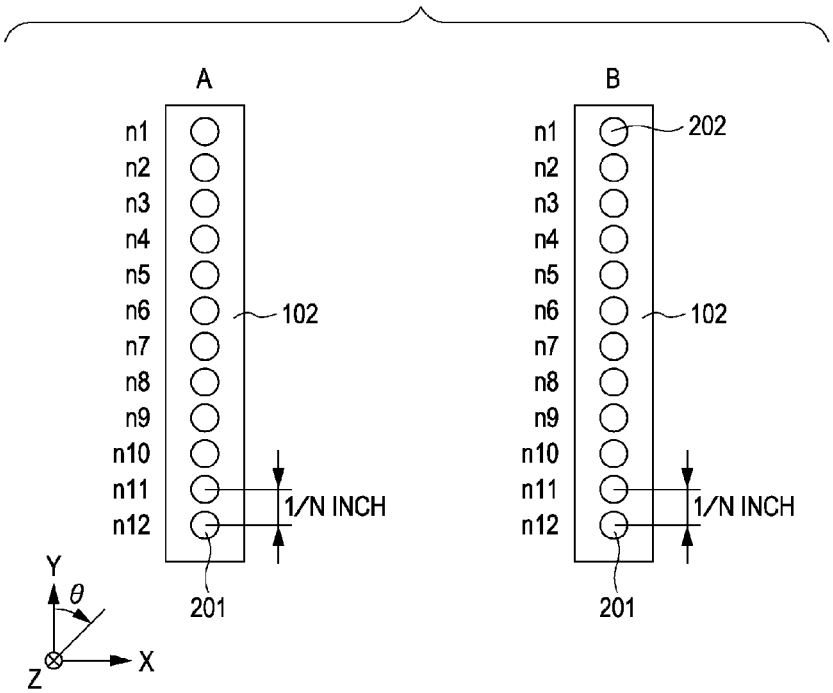
FIG. 2 is a diagram schematically illustrating ink discharge orifice rows in a recording head to which an embodiment of the present invention can be applied.
Figure 23A:
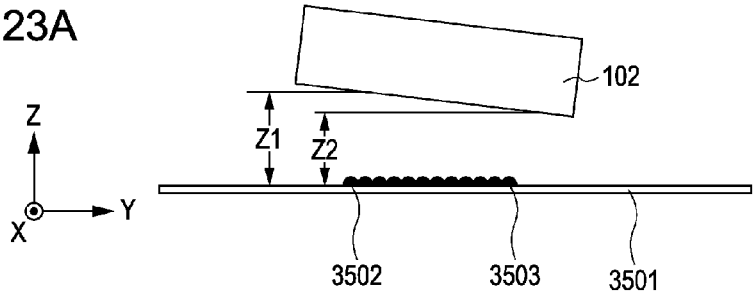
FIG. 23A is a schematic diagram illustrating a case of a recording head surface leaning as to a recording medium surface.
Figure 23B:
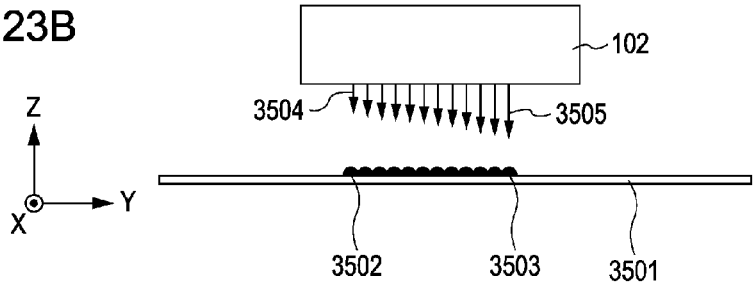
FIG. 23B is a schematic diagram illustrating a case in which the discharge speed of a recording dot to be discharged from each of the discharge orifices of a recording head differs between the discharge orifices.
Figure 23C:
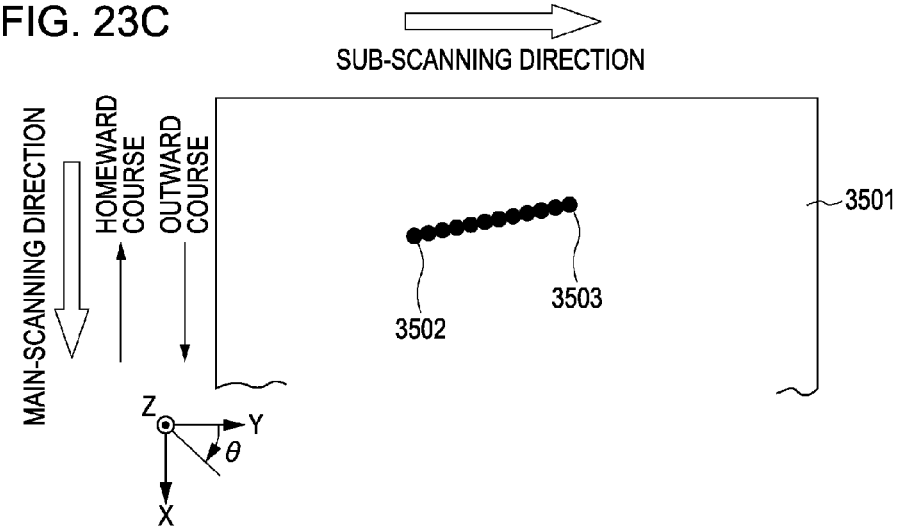
FIG. 23C is a diagram illustrating a state in which dots discharged from the ink discharge orifice row A of the recording head in FIG. 2 are impacted upon a recording medium.
Figure 25:
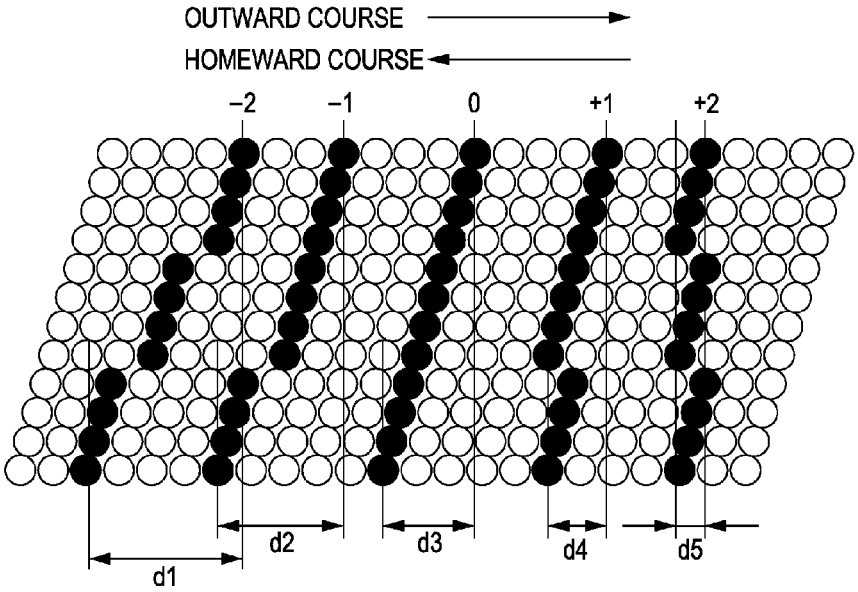
FIG. 25 is a diagram illustrating a state in which an ink discharge orifice group serving as the reference in FIG. 6 is changed.
Figure 26:
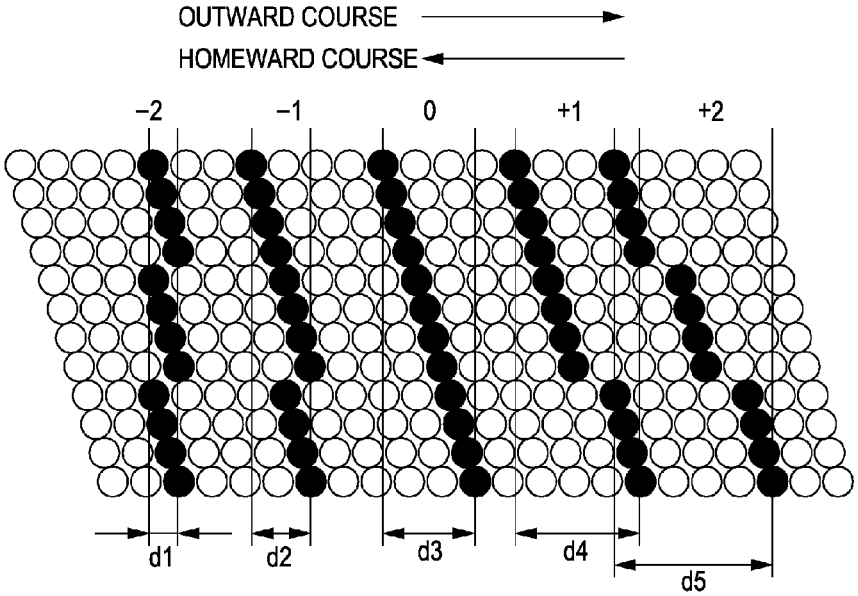
FIG. 26 is a diagram illustrating a state in which an ink discharge orifice group serving as the reference in FIG. 8 is changed.
Figure 27:
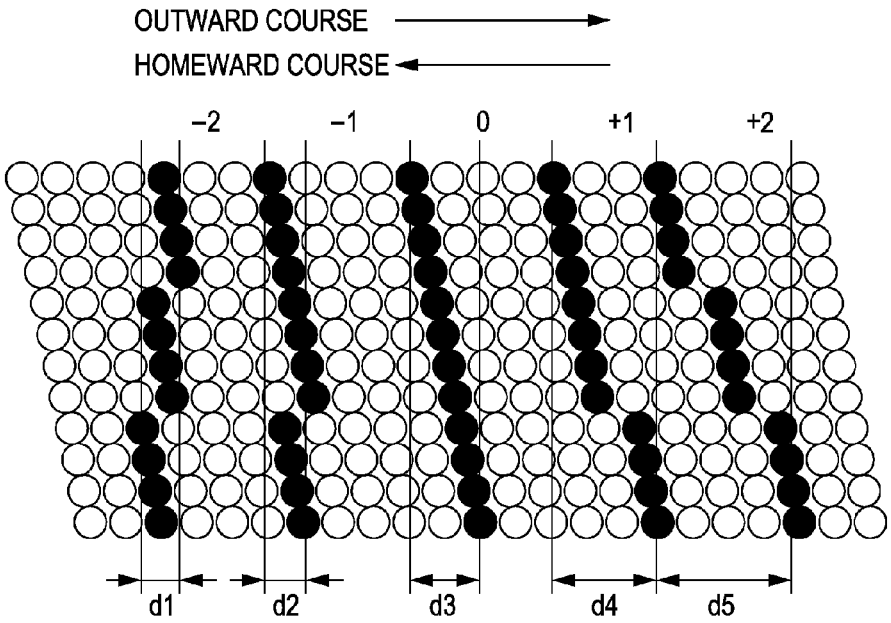
FIG. 27 is a diagram illustrating a state in which an ink discharge orifice group serving as the reference is changed with a discharge orifice row B.
Figure 28:
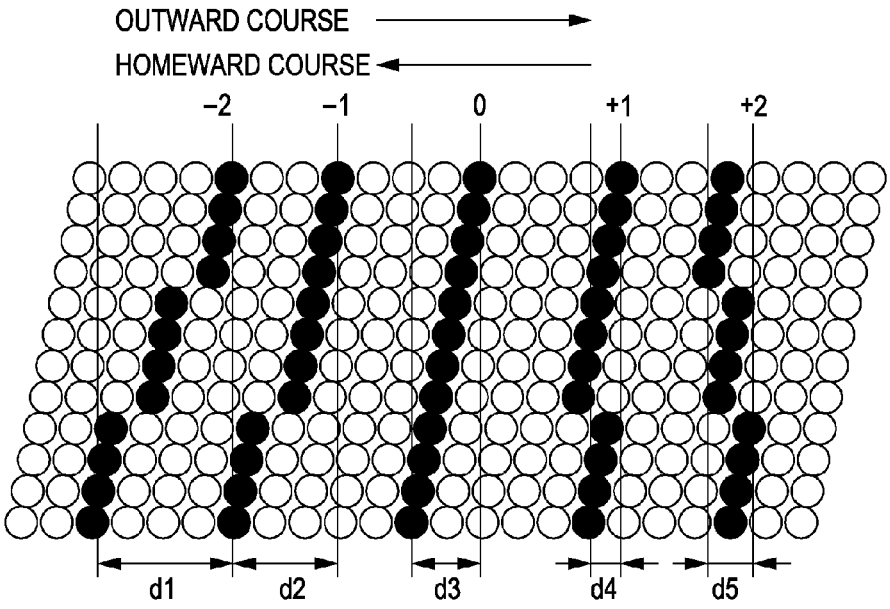
FIG. 28 is a diagram illustrating a state in which an ink discharge orifice group serving as the reference is changed with a discharge orifice row C.
Figure 29:
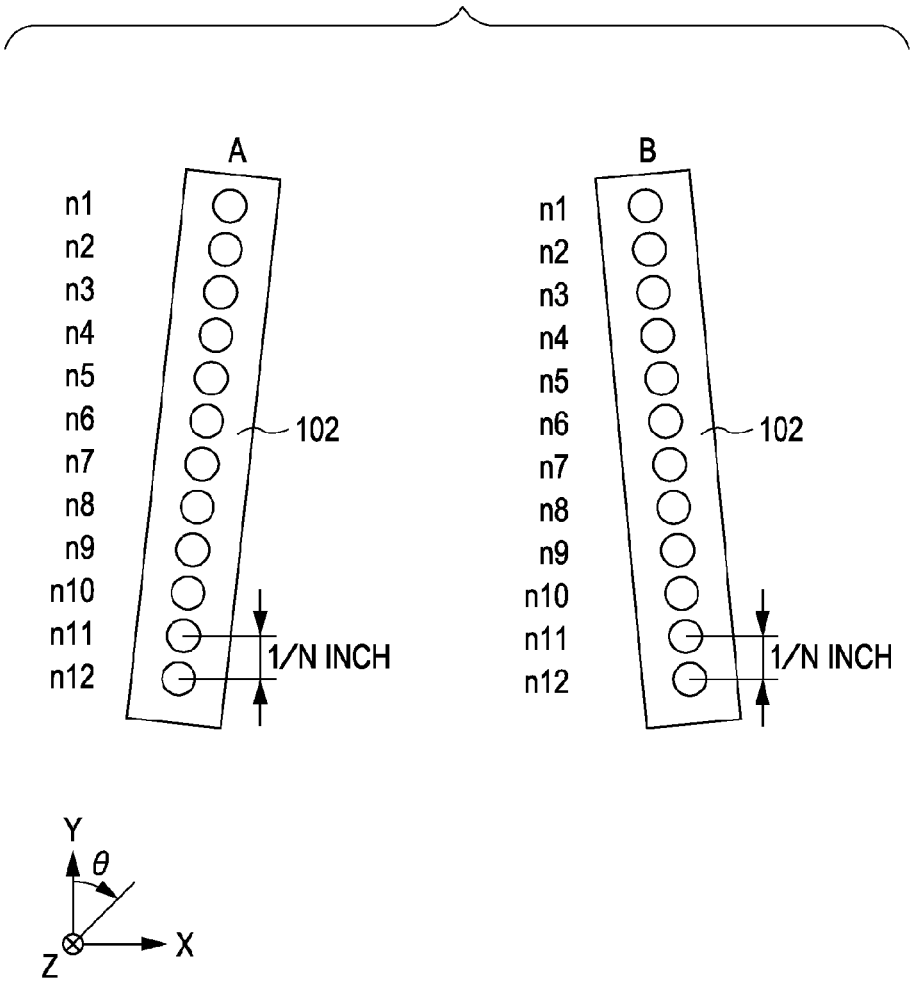
FIG. 29 is a diagram illustrating a state in which a recording head is leaning in the θ direction due to mounting irregularities to the ink-jet recording device main unit.

Also, with the present embodiment, a recording position adjustment value has been selected from the check patterns in FIG. 5A, and then determined, and the sequence to store the check patterns has been set to the sequence of the check patterns A, B, and C, but the sequence is not restricted to this. For example, a different sequence may be employed, such as the sequence of the check patterns B, C, and A, or the sequence of C, A, and B. Also, description has been made that a recording positional deviation in the θ direction is caused by an ink discharge orifice row leaning in the θ direction due to manufacturing irregularities of the recording head 102 as described in FIG. 7, but is not restricted to this, and the same advantage can be obtained even in the following two cases. FIG. 23C schematically illustrates a state in which dots discharged from the ink discharge orifice row A of the recording head 102 in FIG. 2 are impacted upon a recording medium 3501 on the homeward course in the main-scanning direction. A recording dot 3502 is discharged from the ink discharge orifice n12 of the ink discharge orifice row A, and a recording dot 3503 is discharged from the ink discharge orifice n1 of the ink discharge orifice row A. Then, both are impacted upon the recording medium 3501. FIG. 23A illustrates a state in which the recording head leans in the Z direction as to the recording medium surface due to mounting irregularities of the recording head 102 as to the ink-jet recording device main unit. The distance Z1 between the ink discharge orifice n12 of the ink discharge orifice row A and the recording medium is longer than the distance Z2 between the ink discharge orifice n1 of the ink discharge orifice row A and the recording medium. At this time, of the recording dots 3502 and 3503 discharged from the ink discharge orifice row A contemporaneously, the recording dot 3503 having a short distance between the ink discharge orifice and the recording medium is first impacted upon the recording medium, and the recording dot 3502 having a long distance between the ink discharge orifice and the recording medium is finally impacted upon the recording medium. Accordingly, the recording position of the recording dot row formed on the recording medium is deviated in the θ direction. Also, the arrows 3504 and 3505 in FIG. 23B represent the discharge speed of the recording dots discharged from the ink discharge orifice, and the length of each arrow is in proportion to the discharge speed of the corresponding recording dot. Of the recording dots discharged from the ink discharge orifice row A contemporaneously, the recording dot 3505 having a fast ink discharge speed is first impacted upon the recording medium, and the recording dot 3504 having a slow ink discharge speed is finally impacted upon the recording medium. Accordingly, if recording is performed while main-scanning, the recording position of the recording dot row formed on the recording medium is deviated in the θ direction. With the present embodiment, let us say that the ink discharge orifice group serving as the reference to be employed for adjustment of a recording positional deviation in the θ direction within the ink discharge orifice row is set to the ink discharge orifices n1 through n4 of the ink discharge orifice row A or the ink discharge orifices n1 through n4 of the ink discharge orifice row B. However, as illustrated in FIGS. 25 and 26, this may be set to the ink discharge orifices n5 through n8 of the ink discharge orifice row A or the ink discharge orifices n5 through n8 of the ink discharge orifice row B. FIG. 29 is a diagram illustrating a state in which the recording head 102 is leaning in the θ direction due to mounting irregularities of the recording head 102 as to the ink-jet recording device main unit. Thus, even in the event that recording to the recording medium is performed in a state in which the recording head 102 is leaning in the θ direction, the same advantage as the present embodiment can be obtained.

Figure 30:
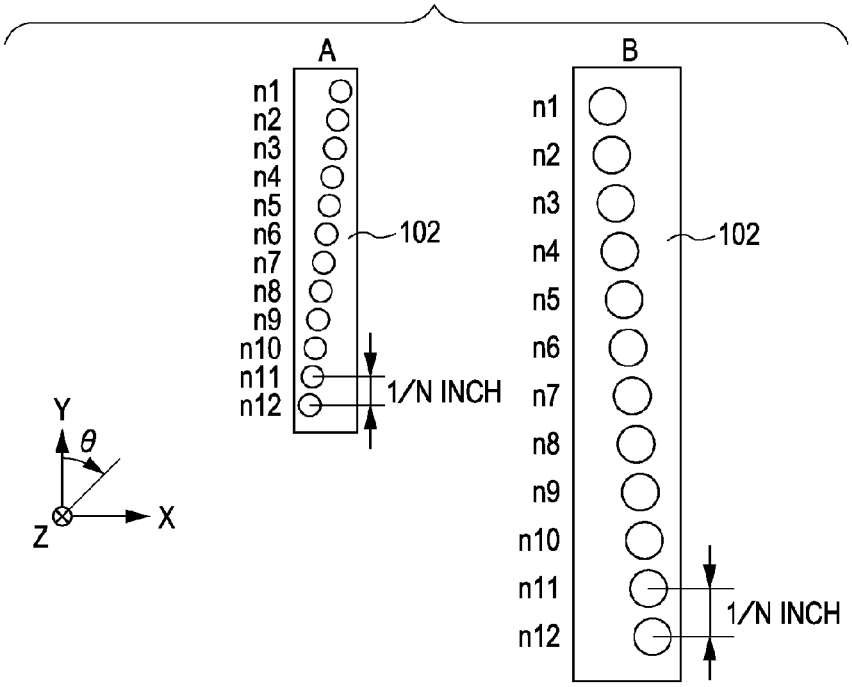
FIG. 30 is a diagram illustrating a case in which the ink discharge orifice interval of two recording heads differs depending on the difference of nozzle sizes.
Figure 31:
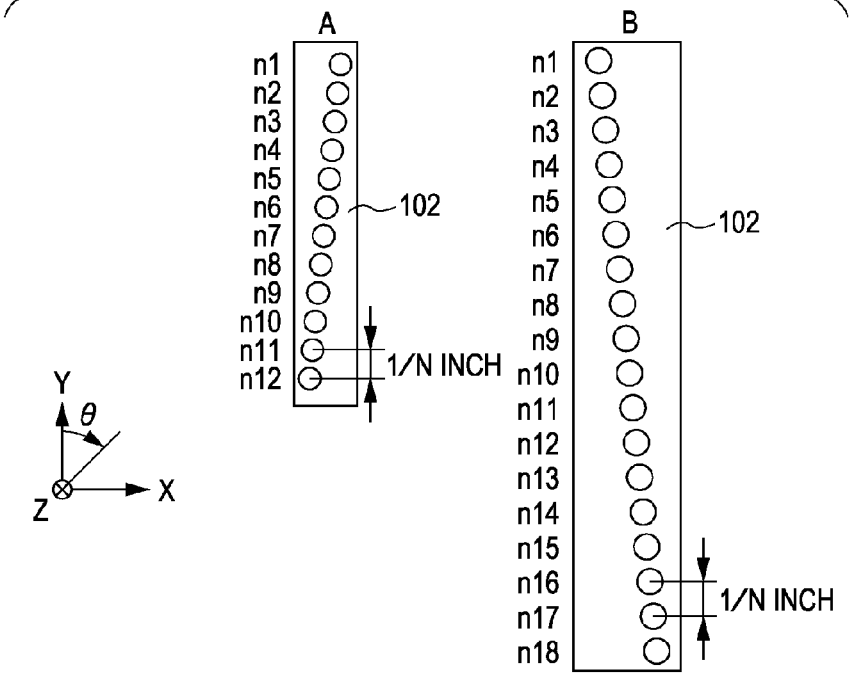
FIG. 31 is a diagram illustrating a case in which the number of ink discharge orifices of two recording heads differs.

The two recording heads employed for the present embodiment have the same number of ink discharge orifices and the same interval of ink discharge orifices. However, as illustrated in FIG. 30, even in the event that the ink discharge orifice intervals of the two recording heads differ, specifically 1/600 inch for the ink discharge orifice row A, and 1/300 inch for the ink discharge orifice row B, the present embodiment is applicable. That is to say, let us say that the ink discharge orifice group serving as the reference to be employed for adjustment of a recording positional deviation in the θ direction within the ink discharge orifice row is set to the ink discharge orifices n1 through n4 of the ink discharge orifice row A and the ink discharge orifices n1 through n4 of the ink discharge orifice row B. Also, as illustrated in FIG. 31, even in the event that the number of ink discharge orifices of the two recording heads differs, specifically 12 for the ink discharge orifice row A, and 18 for the ink discharge orifice row B, the present embodiment is applicable. That is to say, let us say that the ink discharge orifice group serving as the reference to be employed for adjustment of a recording positional deviation in the θ direction within the ink discharge orifice row is set to the ink discharge orifices n1 through n4 of the ink discharge orifice row A and the ink discharge orifices n1 through n6 of the ink discharge orifice row B, whereby the same advantage can be obtained.

Second Exemplary Embodiment

Figure 16:
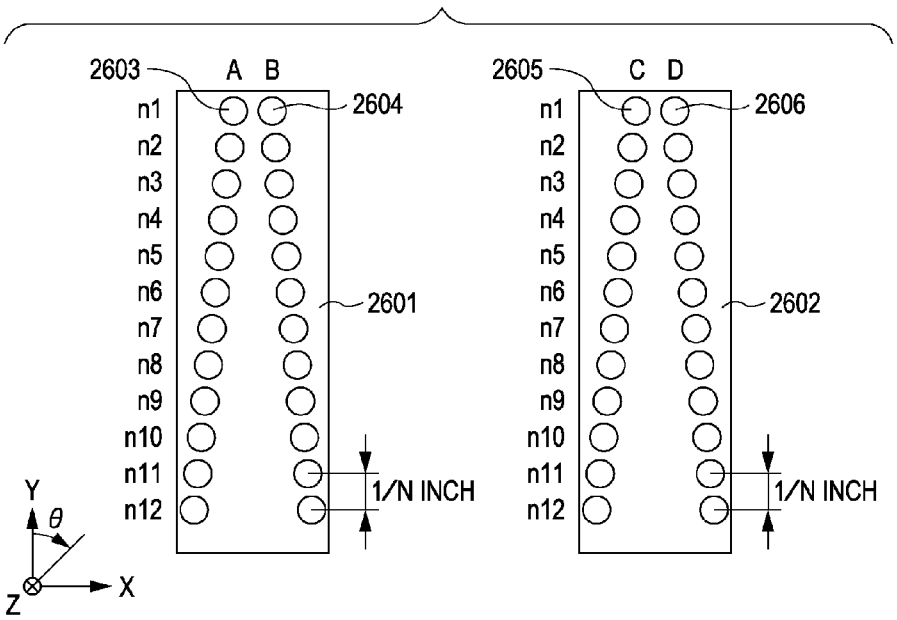
FIG. 16 is a diagram schematically illustrating ink discharge orifice rows in a recording head to which a second embodiment can be applied.

With the second embodiment of the present invention, description will be made regarding a case in which two recording heads each made up of the two ink discharge orifice rows illustrated in FIG. 16. FIG. 16 illustrates the two recording heads of a recording head 2601 including the two rows of the ink discharge orifice row A for discharging black ink, and the ink discharge orifice row B for discharging cyan ink, and a recording head 2602 including the two rows of the ink discharge orifice row C for discharging magenta ink, and the ink discharge orifice row D for discharging yellow ink.

Figure 9:
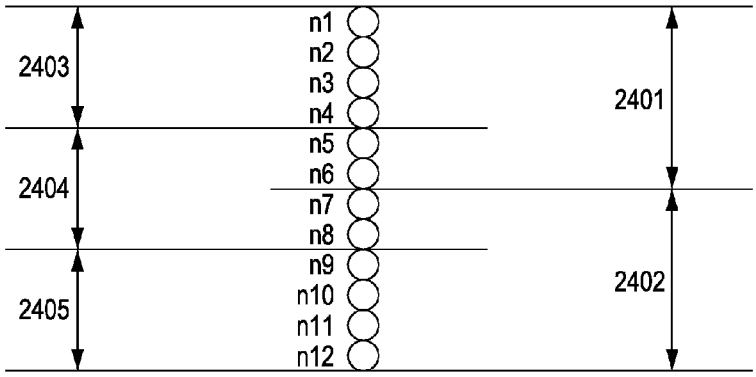
FIG. 9 is a diagram illustrating divisions of ink discharge orifices to be performed at the time of adjusting a recording positional deviation due to the leaning in the rotational direction θ.
Figure 10:
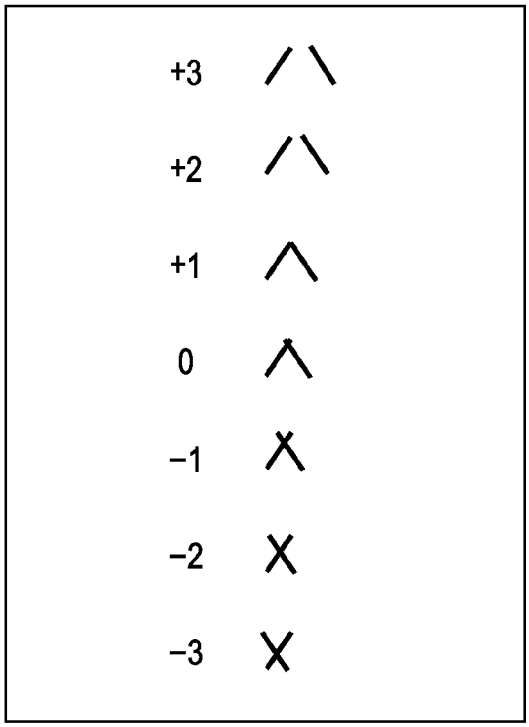
FIG. 10 is a diagram illustrating conventional check patterns for adjusting a recording positional deviation.
Figure 11:
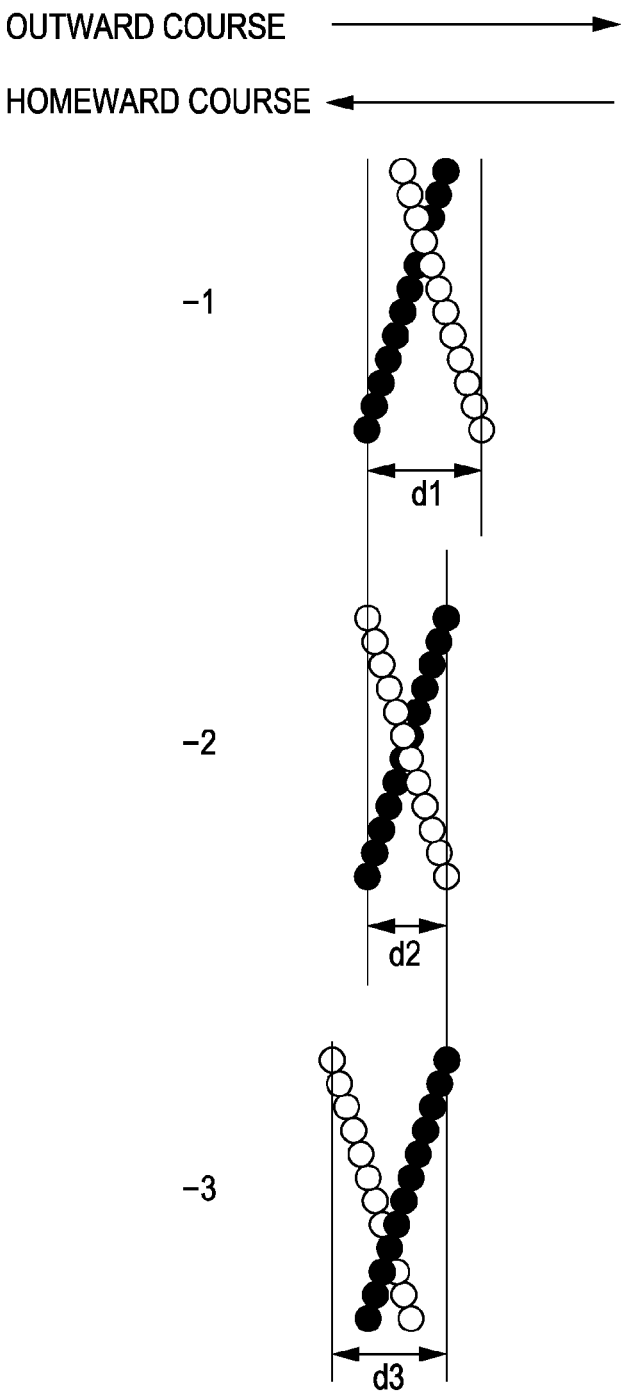
FIG. 11 is a diagram illustrating an enlarged view of a part of FIG. 10.
Figure 12:
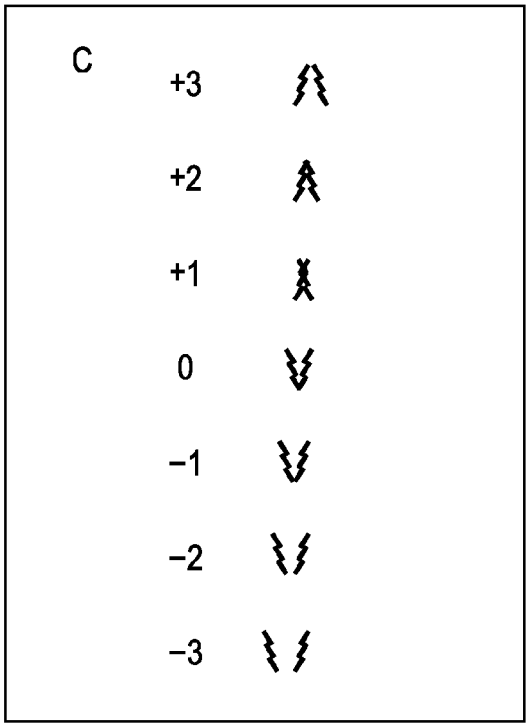
FIG. 12 is a diagram illustrating check patterns for adjusting a recording positional deviation following correction of the leaning of a nozzle row.
Figure 13:
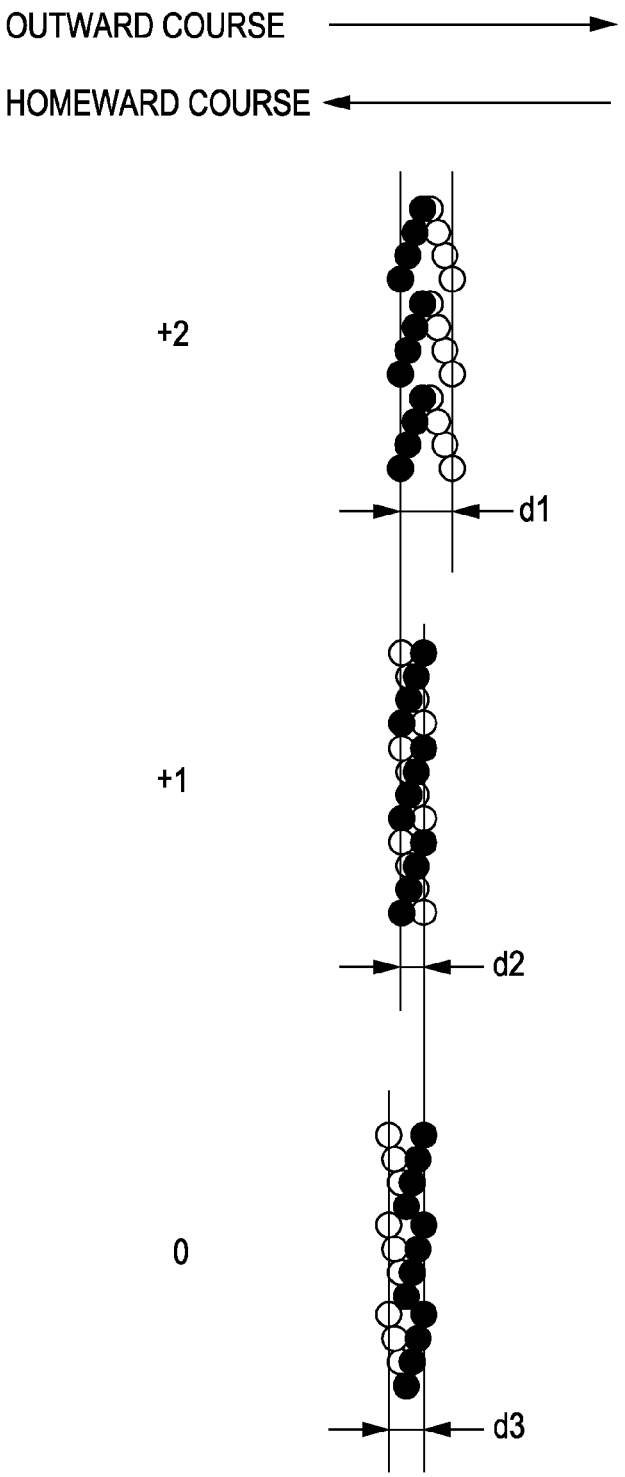
FIG. 13 is diagram illustrating an enlarged view of a part of FIG. 12.
Figure 17:
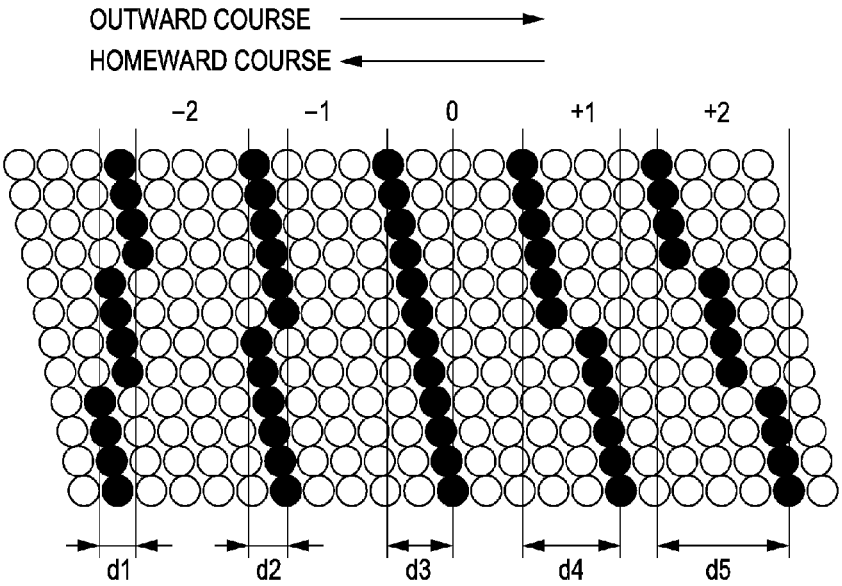
FIG. 17 is a diagram illustrating an enlarged view of a part of FIG. 19.
Figure 18:
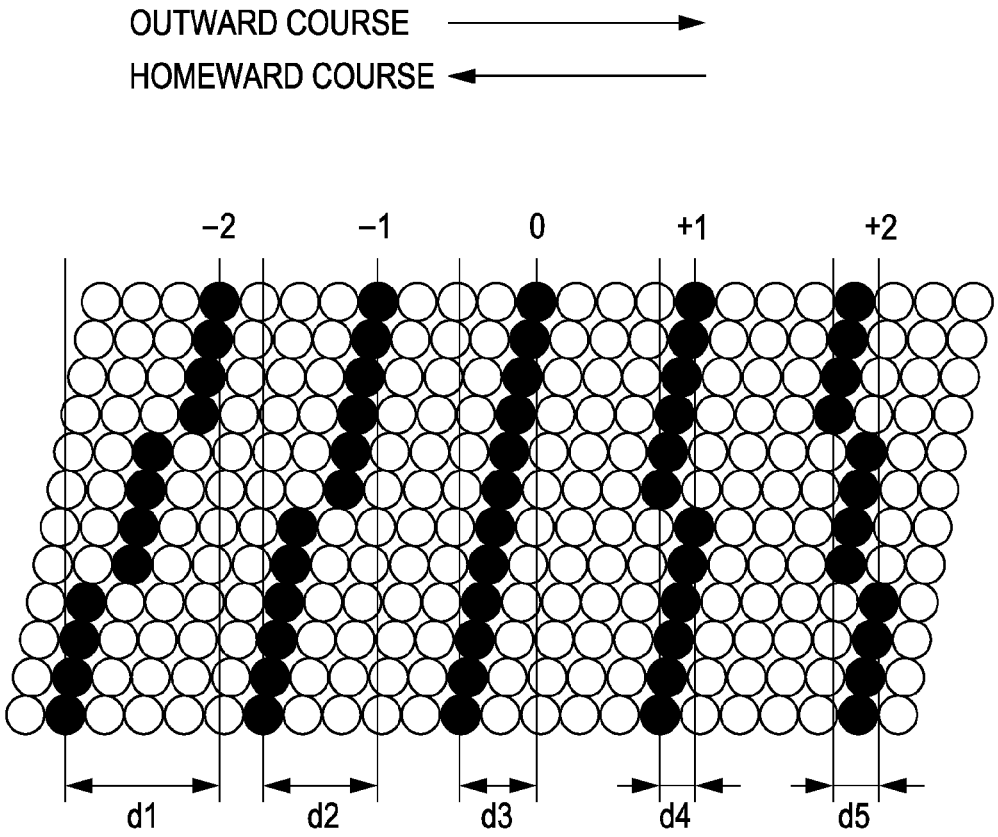
FIG. 18 is a diagram illustrating an enlarged view of a part of FIG. 19.
Figure 19:
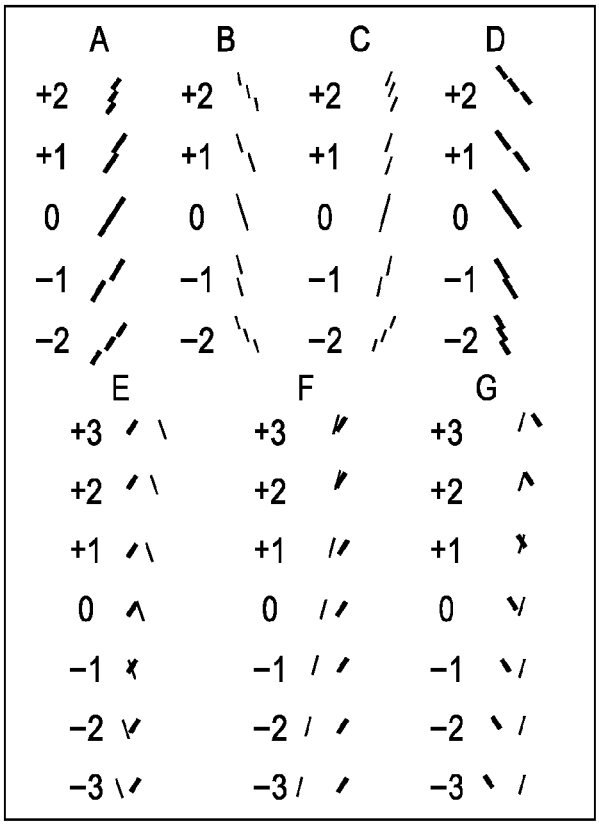
FIG. 19 is a diagram illustrating check patterns according to the second embodiment for adjusting a recording positional deviation.

The recording heads are each configured so as to have the number of ink discharge orifices L=12, and recording pixel density of 600 dpi based on the interval of the ink discharge orifices of 1/600 inch. Also, the amount of discharge from the recording head is arranged such that approximately 2-pl ink droplet per one droplet can be discharged, and the discharge frequency for discharging this ink droplet in a stable manner is 30 kHz, and the discharge speed thereof is approximately 20 m/sec. The speed of the carriage mounting this recording head in the main-scanning direction is approximately 25 inch/sec when recording ink droplets with an interval of 1200 dpi in the main-scanning direction. The recording heads in FIG. 16 lean in the rotational direction θ of the ink discharge orifice rows due to manufacturing irregularities. The ink discharge orifice n1 of the ink discharge orifice row A of the recording head 1601 is apart from the ink discharge orifice n12 by approximately 63 μm of 3 dots at 1200 dpi in the +X direction. The ink discharge orifice n1 of the ink discharge orifice row B of the recording head 1601 is apart from the ink discharge orifice n12 by approximately 42 μm of 2 dots at 1200 dpi in the −X direction. The ink discharge orifice n1 of the ink discharge orifice row C of the recording head 1602 is apart from the ink discharge orifice n12 by approximately 42 μm of 2 dots at 1200 dpi in the +X direction. The ink discharge orifice n1 of the ink discharge orifice row D of the recording head 1602 is apart from the ink discharge orifice n12 by approximately 63 μm of 3 dots at 1200 dpi in the −X direction. Also, a diagram to be obtained by dividing the ink discharge orifice rows A through D illustrated in FIG. 16 into two or more ink discharge orifice groups is the same as FIG. 9. FIG. 19 illustrates check patterns for obtaining an adjustment value for adjusting a recording positional deviation in the rotational direction θ caused at the time of recording using the recording head in FIG. 16, and check patterns for obtaining an adjustment value for adjusting a recording positional deviation between two ink discharge orifice rows. Check patterns A are recorded on the outward course of the ink discharge orifice row A, and are the same patterns as +2 through −2 of the check patterns A in FIG. 5B, and FIG. 6 is an enlargement view thereof. Check patterns B are recorded on the outward course of the ink discharge orifice row B, and FIG. 17 is an enlarged view thereof. The +2 through −2 of the check patterns B correspond to the +2 through −2 of the check patterns in FIG. 17. Check patterns C are recorded on the outward course of the ink discharge orifice row C, and FIG. 18 is an enlarged view thereof. The +2 through −2 of the check patterns C correspond to the +2 through −2 of the check patterns in FIG. 18. Check patterns D are recorded on the outward course of the ink discharge orifice row D, and are the same patterns as +2 through −2 of the check patterns B in FIG. 5B, and FIG. 8 is an enlargement view thereof. The adjustment resolution of the check patterns A, B, C, and D is approximately 21 μm of 1200 dpi, and can adjust the deviation of a dot recording position within a range of five-stage patterns of −2 through +2. With respect to the pattern corresponding to 0 in FIG. 17, recording is performed by setting the discharge timing from all of the ink discharge orifices to the same discharge timing without dividing the ink discharge orifice row B, and the amount of deviation d3 of the recording position is approximately 42 μm.

With respect to the pattern corresponding to +1 in FIG. 17, the ink discharge orifice row B is divided into two, the recording timing at the ink discharge orifice group 2402 is 1200 dpi, which is slower than the ink discharge orifice group 2401 including the ink discharge orifice group 2403 serving as the reference by one pixel, and the amount of deviation d4 of the recording position of the ink discharge orifice row B is approximately 63 μm. With respect to the pattern corresponding to +2 in FIG. 17, the ink discharge orifice row B is divided into three, the recording timing at the ink discharge orifice group 2404 is 1200 dpi, which is slower than the ink discharge orifice group 2403 serving as the reference by one pixel, and further the recording timing at the ink discharge orifice group 2405 is 1200 dpi, which is slower than the ink discharge orifice group 2403 serving as the reference by two pixels. The amount of deviation d5 of the recoding position of the ink discharge orifice row B at this time is approximately 84 μm.

With respect to the pattern corresponding to −1 in FIG. 17, the ink discharge orifice row B is divided into two, the recording timing at the ink discharge orifice group 2402 is 1200 dpi, which is faster than the ink discharge orifice group 2401 including the ink discharge orifice group 2403 serving as the reference by one pixel, and the amount of deviation d2 of the recording position of the ink discharge orifice row B is approximately 21 μm. With respect to the pattern corresponding to −2 in FIG. 17, the ink discharge orifice row B is divided into three, the recording timing at the ink discharge orifice group 2404 is 1200 dpi, which is faster than the ink discharge orifice group 2403 serving as the reference by one pixel, and further the recording timing at the ink discharge orifice group 2405 is 1200 dpi, which is faster than the ink discharge orifice group 2403 serving as the reference by two pixels. The amount of deviation d2 of the recoding position of the ink discharge orifice row B at this time is approximately 42 μm. With respect to the pattern corresponding to 0 in FIG. 18, recording is performed by setting the discharge timing from all of the ink discharge orifices to the same discharge timing without dividing the ink discharge orifice row C, and the amount of deviation d3 of the recording position is approximately 42 μm. With respect to the pattern corresponding to +1 in FIG. 18, the ink discharge orifice row C is divided into two, the recording timing at the ink discharge orifice group 2402 is 1200 dpi, which is slower than the ink discharge orifice group 2401 including the ink discharge orifice group 2403 serving as the reference by one pixel, and the amount of deviation d4 of the recording position of the ink discharge orifice row C is approximately 21 μm. With respect to the pattern corresponding to +2 in FIG. 18, the ink discharge orifice row C is divided into three, the recording timing at the ink discharge orifice group 2404 is 1200 dpi, which is slower than the ink discharge orifice group 2403 serving as the reference by one pixel, and further the recording timing at the ink discharge orifice group 2405 is 1200 dpi, which is slower than the ink discharge orifice group 2403 serving as the reference by two pixels. The amount of deviation d5 of the recoding position of the ink discharge orifice row C at this time is approximately 42 μm. With respect to the pattern corresponding to −1 in FIG. 18, the ink discharge orifice row C is divided into two, the recording timing at the ink discharge orifice group 2402 is 1200 dpi, which is faster than the ink discharge orifice group 2401 including the ink discharge orifice group 2403 serving as the reference by one pixel, and the amount of deviation d2 of the recording position of the ink discharge orifice row C is approximately 63 μm. With respect to the pattern corresponding to −2 in FIG. 18, the ink discharge orifice row C is divided into three, the recording timing at the ink discharge orifice group 2404 is 1200 dpi, which is faster than the ink discharge orifice group 2403 serving as the reference by one pixel, and further the recording timing at the ink discharge orifice group 2405 is 1200 dpi, which is faster than the ink discharge orifice group 2403 serving as the reference by two pixels. The amount of deviation d2 of the recoding position of the ink discharge orifice row C at this time is approximately 84 μm.

Figure 22:
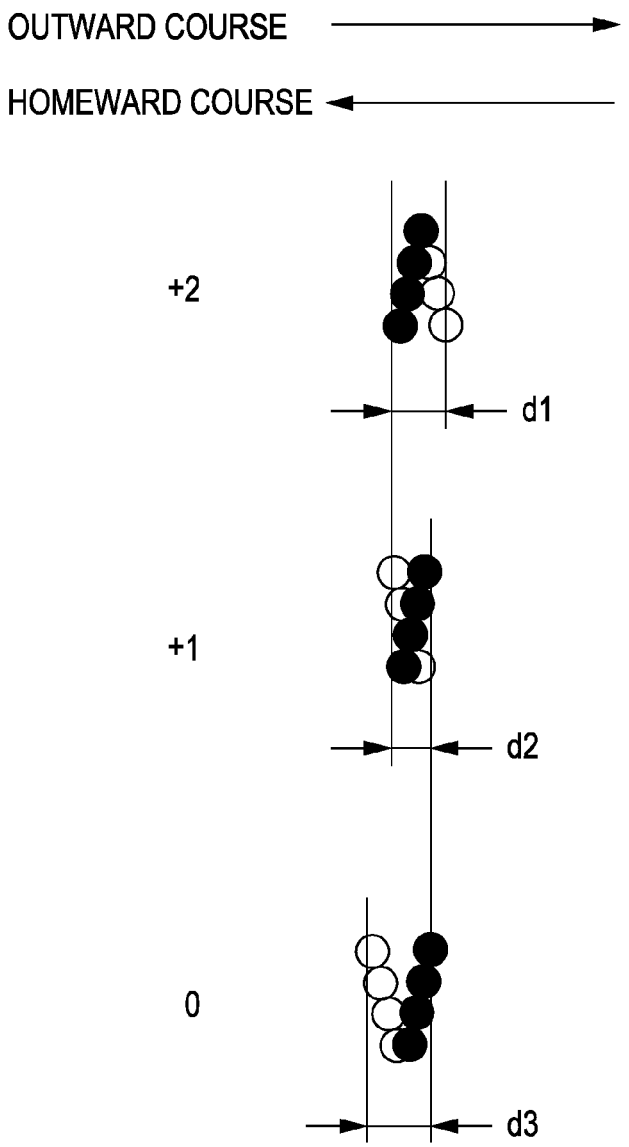
FIG. 22 is a diagram illustrating an enlarged view of a part of FIG. 19.
Figure 24A:
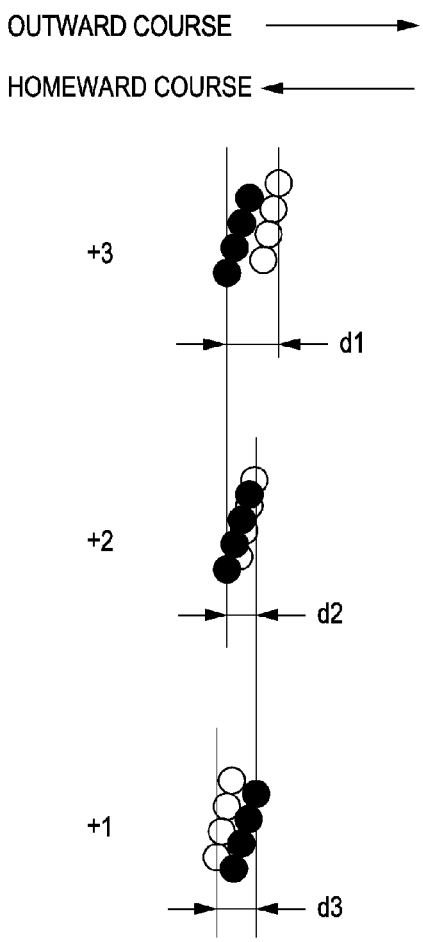
FIG. 24A is a diagram showing an enlarged view of the patterns F in FIG. 19.
Figure 24B:
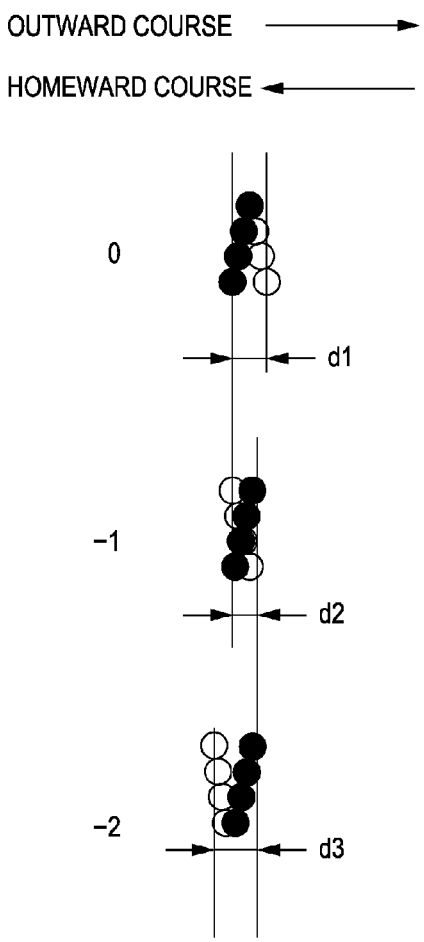
FIG. 24B is a diagram showing an enlarged view of the patterns G in FIG. 19.

The check patterns E in FIG. 19 are check patterns recorded on the outward course of the ink discharge orifice group 2403 serving as the reference to be employed for adjustment of the deviation of a recording position in the θ direction within the ink discharge orifice row A, and the ink discharge orifice group 2403 serving as the reference to be employed for adjustment of the deviation of a recording position in the θ direction within the ink discharge orifice row B, and FIG. 24B is an enlarged view of 0 through −2 of the check patterns E in FIG. 19. Similarly, the check patterns F are check patterns recorded on the outward course of the ink discharge orifice group 2403 serving as the reference to be employed for adjustment of the deviation of a recording position in the θ direction within the ink discharge orifice row A, and the ink discharge orifice group 2403 serving as the reference to be employed for adjustment of the deviation of a recording position in the θ direction within the ink discharge orifice row C, and FIG. 24A is an enlarged view of +1 through +3 of the check patterns F in FIG. 19. The check patterns G are check patterns recorded on the outward course of the ink discharge orifice group 2403 serving as the reference to be employed for adjustment of the deviation of a recording position in the θ direction within the ink discharge orifice row C, and the ink discharge orifice group 2403 serving as the reference to be employed for adjustment of the deviation of a recording position in the θ direction within the ink discharge orifice row D, and FIG. 22 is an enlarged view of 0 through +2 of the check pattern G in FIG. 19. An arrangement is made wherein the discharge timing is slow in the + direction, and is fast in the − direction. The adjustment resolution of the check patterns E, F, and G is approximately 21 μm of 1200 dpi, and can adjust the deviation of a dot recording position within a range of seven-stage patterns of −3 through +3.

With respect to the pattern corresponding to −1 illustrated in FIG. 24B, the black circles to be recorded at the ink discharge orifice group 2403 serving as the reference to be employed for adjustment of the deviation of a recording position in the θ direction within the ink discharge orifice row A, and the white circles to be recorded at the ink discharge orifice group 2403 serving as the reference to be employed for adjustment of the deviation of a recording position in the θ direction within the ink discharge orifice row B, are overlapped, and the amount of deviation in the X direction between the two rows is approximately 21 μm. With respect to the pattern corresponding to 0 in FIG. 24B, the recording timing of the white circles to be recorded at the ink discharge orifice group 2403 serving as the reference to be employed for adjustment of the deviation of a recording position in the θ direction within the ink discharge orifice row B is slower than the recording timing of the black circles to be recorded at the ink discharge orifice group 2403 serving as the reference to be employed for adjustment of the deviation of a recording position in the θ direction within the ink discharge orifice row A, and the amount of deviation in the X direction between the two rows is approximately 42 μm.

With respect to the pattern corresponding to −2 in FIG. 24B, the recording timing of the white circles to be recorded at the ink discharge orifice group 2403 serving as the reference to be employed for adjustment of the deviation of a recording position in the θ direction within the ink discharge orifice row B is faster than the recording timing of the black circles to be recorded at the ink discharge orifice group 2403 serving as the reference to be employed for adjustment of the deviation of a recording position in the θ direction within the ink discharge orifice row A, and the amount of deviation in the X direction between the two rows is approximately 42 μm.

With respect to the pattern corresponding to +2 in FIG. 24A, the black circles to be recorded at the ink discharge orifice group 2403 serving as the reference to be employed for adjustment of the deviation of a recording position in the θ direction within the ink discharge orifice row A, and the white circles to be recorded at the ink discharge orifice group 2403 serving as the reference to be employed for adjustment of the deviation of a recording position in the θ direction within the ink discharge orifice row C, are overlapped, and the amount of deviation in the X direction between the two rows is approximately 21 μm. With respect to the pattern corresponding to +3 in FIG. 24A, the recording timing of the white circles to be recorded at the ink discharge orifice group 2403 serving as the reference to be employed for adjustment of the deviation of a recording position in the θ direction within the ink discharge orifice row C is slower than the recording timing of the black circles to be recorded at the ink discharge orifice group 2403 serving as the reference to be employed for adjustment of the deviation of a recording position in the θ direction within the ink discharge orifice row A, and the amount of deviation in the X direction between the two rows is approximately 42 μm. With respect to the pattern corresponding to +1 in FIG. 24A, the recording timing of the white circles to be recorded at the ink discharge orifice group 2403 serving as the reference to be employed for adjustment of the deviation of a recording position in the θ direction within the ink discharge orifice row C is faster than the recording timing of the black circles to be recorded at the ink discharge orifice group 2403 serving as the reference to be employed for adjustment of the deviation of a recording position in the θ direction within the ink discharge orifice row A, and the amount of deviation in the X direction between the two rows is approximately 42 μm.

With respect to the pattern corresponding to +1 in FIG. 22, the black circles to be recorded at the ink discharge orifice group 2403 serving as the reference to be employed for adjustment of the deviation of a recording position in the θ direction within the ink discharge orifice row C, and the white circles to be recorded at the ink discharge orifice group 2403 serving as the reference to be employed for adjustment of the deviation of a recording position in the θ direction within the ink discharge orifice row D, are overlapped, and the amount of deviation in the X direction between the two rows is approximately 21 μm. With respect to the pattern corresponding to +2 in FIG. 22, the recording timing of the white circles to be recorded at the ink discharge orifice group 2403 serving as the reference to be employed for adjustment of the deviation of a recording position in the θ direction within the ink discharge orifice row D is slower than the recording timing of the black circles to be recorded at the ink discharge orifice group 2403 serving as the reference to be employed for adjustment of the deviation of a recording position in the θ direction within the ink discharge orifice row C, and the amount of deviation in the X direction between the two rows is approximately 42 μm. With respect to the pattern corresponding to 0 in FIG. 22, the recording timing of the white circles to be recorded at the ink discharge orifice group 2403 serving as the reference to be employed for adjustment of the deviation of a recording position in the θ direction within the ink discharge orifice row D is faster than the recording timing of the black circles to be recorded at the ink discharge orifice group 2403 serving as the reference to be employed for adjustment of the deviation of a recording position in the θ direction within the ink discharge orifice row C, and the amount of deviation in the X direction between the two rows is approximately 42 μm.

Figure 33:
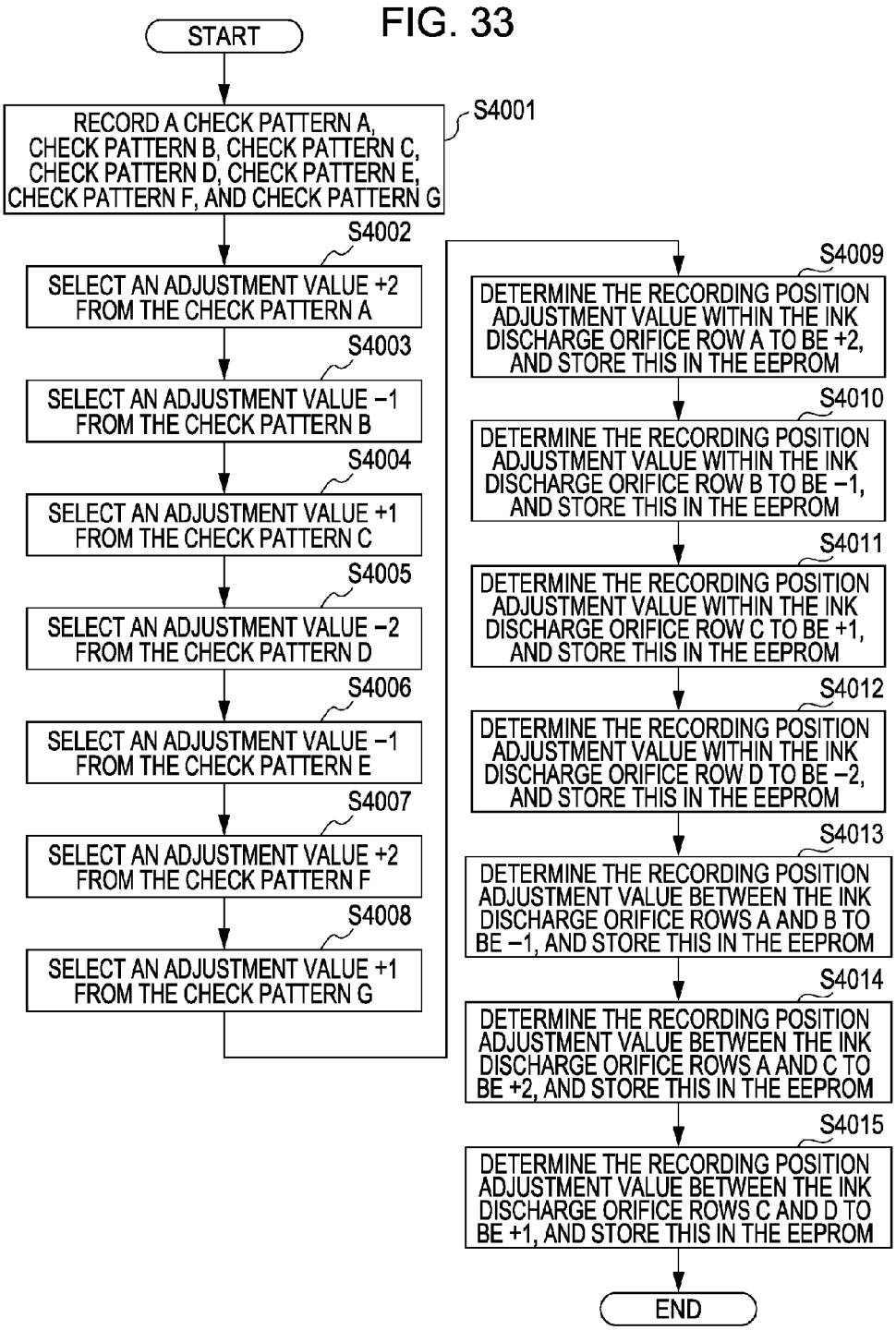
FIG. 33 is a flowchart according to an exemplary embodiment for describing adjustment of a recording positional deviation using the recording head in FIG. 16.
Figure 34:
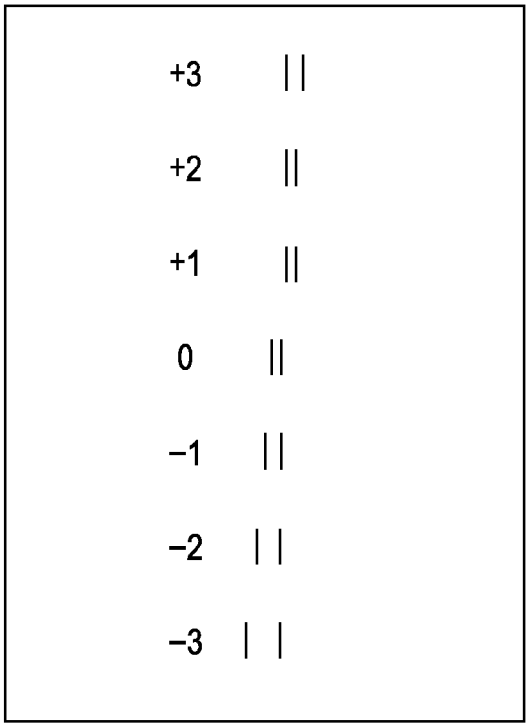
FIG. 34 is a diagram illustrating conventional check patterns for adjusting a recording positional deviation.
Figure 35:
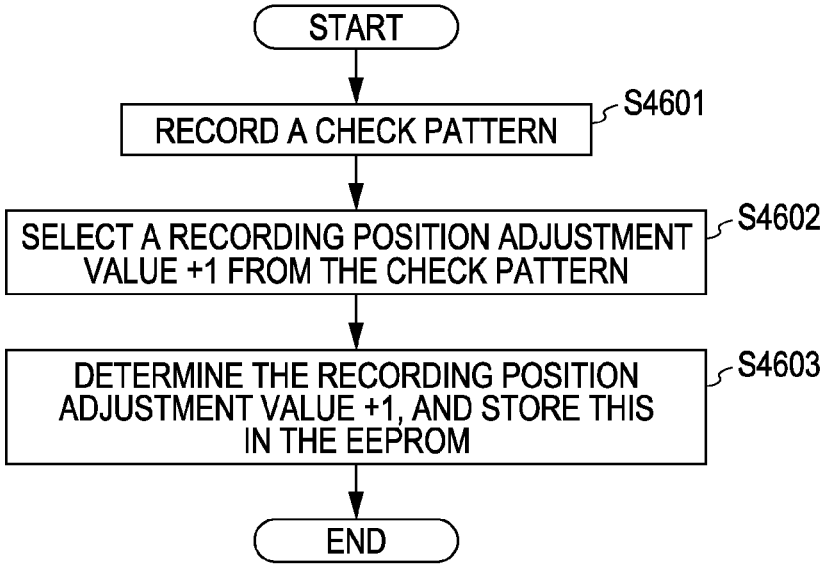
FIG. 35 is a flowchart illustrating a conventional adjustment of a recording positional deviation.

FIG. 33 is a flowchart according to the present embodiment for describing adjustment of a recording positional deviation using the recording head in FIG. 16.

First, in step 4001, the check patterns A for obtaining an adjustment value for adjusting the deviation of a recording position in the θ direction within the ink discharge orifice row A, check patterns B for obtaining an adjustment value for adjusting the deviation of a recording position in the θ direction within the ink discharge orifice row B, check patterns C for obtaining an adjustment value for adjusting the deviation of a recording position in the θ direction within the ink discharge orifice row C, check patterns D for obtaining an adjustment value for adjusting the deviation of a recording position in the θ direction within the ink discharge orifice row D, check patterns E for obtaining an adjustment value for adjusting the deviation of a recording position between the ink discharge orifice row A and the ink discharge orifice row B, check patterns F for obtaining an adjustment value for adjusting the deviation of a recording position between the ink discharge orifice row A and the ink discharge orifice row C, and check patterns G for obtaining an adjustment value for adjusting the deviation of a recording position between the ink discharge orifice row C and the ink discharge orifice row D, are recorded.

In step 4002, the number +2 is selected from the check patterns A in FIG. 19, which corresponds with the check pattern having the least amount of deviation at the recording position, for obtaining an adjustment value for adjusting a recording positional deviation in the θ direction within the ink discharge orifice row A.

In step 4003, the number −1 is selected from the check patterns B in FIG. 19, which corresponds with the check pattern having the least amount of deviation at the recording position, for obtaining an adjustment value for adjusting a recording positional deviation in the θ direction within the ink discharge orifice row B.

In step 4004, the number +1 is selected from the check patterns C in FIG. 19, which corresponds with the check pattern having the least amount of deviation at the recording position, for obtaining an adjustment value for adjusting a recording positional deviation in the θ direction within the ink discharge orifice row C.

In step 4005, the number −2 is selected from the check patterns D in FIG. 19, which corresponds with the check pattern having the least amount of deviation at the recording position, for obtaining an adjustment value for adjusting a recording positional deviation in the θ direction within the ink discharge orifice row D.

In step 4006, the number −1 is selected from the check patterns E in FIG. 19, which corresponds with the check pattern having the least amount of deviation in the X direction between the two rows, for obtaining an adjustment value for adjusting the deviation of a recording position between the two rows of the ink discharge orifice row A and the ink discharge orifice row B. In step 4007, the number +2 is selected from the check patterns F in FIG. 19, which corresponds with the check pattern having the least amount of deviation in the X direction between the two rows, for obtaining an adjustment value for adjusting the deviation of a recording position between the two rows of the ink discharge orifice row A and the ink discharge orifice row C. In step 4008, the number +1 is selected from the check patterns G in FIG. 19, which corresponds with the check pattern having the least amount of deviation in the X direction between the two rows is the least, for obtaining an adjustment value for adjusting the deviation of a recording position between the two rows of the ink discharge orifice row C and the ink discharge orifice row D. In step 4009, the selected number +2 or a value associated with the selected number is stored in the EEPROM of the recording device main unit as a recording position adjustment value within the ink discharge orifice row A. In step 4010, the selected number −1 or a value associated with the selected number is stored in the EEPROM of the recording device main unit as a recording position adjustment value within the ink discharge orifice row B. In step 4011, the selected number +1 or a value associated with the selected number is stored in the EEPROM of the recording device main unit as a recording position adjustment value within the ink discharge orifice row C. In step 4012, the selected number −2 or a value associated with the selected number is stored in the EEPROM of the recording device main unit as a recording position adjustment value within the ink discharge orifice row D.

In step 4013, the selected number −1 or a value associated with the selected number is stored in the EEPROM of the recording device main unit as a recording position adjustment value between the two rows of the ink discharge orifice row A and the ink discharge orifice row B. In step 4014, the selected number +2 or a value associated with the selected number is stored in the EEPROM of the recording device main unit as a recording position adjustment value between the two rows of the ink discharge orifice row A and the ink discharge orifice row C. In step 4015, the selected number +1 or a value associated with the selected number is stored in the EEPROM of the recording device main unit as a recording position adjustment value between the two rows of the ink discharge orifice row C and the ink discharge orifice row D. Recording is performed using these stored recording position adjustment values.

As described above, with the recording head in which the ink discharge orifice rows in FIG. 16 have the leaning θ, upon employing a conventional method for obtaining an adjustment value for adjusting the deviation of a recording position between the ink discharge orifice rows, the least amount of a recording positional deviation exhibits 63 μm, but on the other hand, upon employing the method described with the present embodiment for obtaining an adjustment value for adjusting a recording positional deviation, the least amount of a recording positional deviation becomes 21 μm, whereby a recording positional deviation can be reduced.

Thus, the present embodiment can provide the method for obtaining an adjustment value for adjusting the deviation of a recording position between the ink discharge orifice rows, which can reduce image deterioration due to the recording positional deviation of a recoding dot caused by manufacturing irregularities of recording devices and recording heads, and mounting irregularities of a recording head, and further without reflecting the recording position adjustment values within the respective ink discharge orifice rows. With the present embodiment, description has been made regarding the case in which the two recording heads each made up the two ink discharge orifice rows illustrated in FIG. 16 are provided, the ink discharge orifice row A discharges black ink, the ink discharge orifice row B discharges cyan ink, the ink discharge orifice row C discharges magenta ink, and the ink discharge orifice row D discharges yellow ink. However, the configuration according to the present embodiment is not restricted to this, and even in the event that different colors such as red, blue, and so forth are discharged, and two or more recording heads including two or more ink discharge orifice rows are provided, the present embodiment is applicable.

Also, with the present embodiment, description has been made using ink droplets of approximately 2 pl, but the present invention is not restricted to this. Ink droplets may be greater than approximately 2 pl, or may be smaller, and further, may be changed in size for each color or each discharge orifice row. The present embodiment can be applied to such arrangements as well. With the present embodiment, a user can manually input a selected value directly to the ink-jet recording device main unit via a PC printer driver. Alternatively, an arrangement may be made wherein check patterns are scanned using an optical sensor or the like, a pattern in which the amount of a recording positional deviation is the least is detected, and the detected pattern value can be input automatically.

With the present embodiment, the method has been described for recording all of the check patterns by changing the discharge timing. However, the method is not restricted to this, and includes the case of creating check patterns based on a plurality of recording data prepared beforehand. The above check patterns may be created within the recording device, or may be created within a host device which generates recording data. With the present embodiment, description has been made regarding the method for recording all of the patterns on the outward course, but the method is not restricted to this, the case of recording the check patterns on the homeward course is also included.

Also, with the present embodiment, the vertical ruled line patterns using all of the ink discharge orifices of which timing for discharging ink from the other ink discharge orifice groups is changed as to the ink discharge orifice group serving as the reference to be employed by adjustment unit within the ink discharge orifice rows at the time of recording image data have been employed as check patterns for obtaining an adjustment value for adjusting the deviation of a recording position in the θ direction within each of the ink discharge orifice rows, and an adjustment value has been obtained from the amount of a recording positional deviation in the main-scanning direction, but the check patterns are not restricted to these. Other check patterns may be employed, which can determine the amount of a recording positional deviation in the main-scanning direction between the recording position from the ink discharge orifice at the upstream side and the recording position from the ink discharge orifice at the downstream side of an ink discharge orifice row.

Also, with the present embodiment, the vertical ruled line patterns from the respective ink discharge orifice rows using the ink discharge orifice group serving as the reference to be employed by the adjustment unit within the ink discharge orifice rows at the time of recording image data have been employed as check patterns for obtaining an adjustment value for adjusting the deviation of a recording position between ink discharge orifice rows, and an adjustment value has been obtained from the amount of a recording positional deviation in the main-scanning direction of each of the vertical ruled line patterns, but the check patterns are not restricted to these. Other check patterns may be employed, which can determine the amount of a recording position in the main-scanning direction of the respective ink discharge orifice rows using at least a part of the ink discharge orifice group serving as the reference to be employed by the adjustment unit within the ink discharge orifice rows at the time of recording image data.

With the present embodiment, description has been made that a recording positional deviation in the θ direction is caused by an ink discharge orifice row leaning in the θ direction due to manufacturing irregularities of the recording head 102 as described in FIG. 19. However, the factor to cause a recording positional deviation in the θ direction is not restricted to this. FIG. 23C illustrates a state in which dots discharged from the ink discharge orifice row A of the recording head 102 in FIG. 2 are impacted upon the recording medium 3501 on the homeward course in the main-scanning direction. The recording dot 3502 is discharged from the ink discharge orifice n12 of the ink discharge orifice row A, and the recording dot 3503 is discharged from the ink discharge orifice n1 of the ink discharge orifice row A. Then, both are impacted upon the recording medium 3501. FIG. 23A illustrates a state in which the recording head leans in the Z direction as to the recording medium surface due to mounting irregularities of the recording head 102 as to the ink-jet recording device main unit. The distance Z1 between the ink discharge orifice n12 of the ink discharge orifice row A and the recording medium is longer than the distance Z2 between the ink discharge orifice n1 of the ink discharge orifice row A and the recording medium. At this time, of the recording dots 3502 and 3503 discharged from the ink discharge orifice row A contemporaneously, the recording dot 3503 having a short distance between the ink discharge orifice and the recording medium is first impacted upon the recording medium, and the recording dot 3502 having a long distance between the ink discharge orifice and the recording medium is finally impacted upon the recording medium.

Also, the arrows 3504 and 3505 in FIG. 23B represent the discharge speed of the recording dots discharged from the ink discharge orifice, and the length of each arrow is in proportion to the discharge speed of the corresponding recording dot. Of the recording dots discharged from the ink discharge orifice row A contemporaneously, the recording dot 3505 having a fast ink discharge speed is first impacted upon the recording medium, and the recording dot 3504 having a slow ink discharge speed is finally impacted upon the recording medium, and accordingly, the recording position of the recording dot row formed on the recording medium leans in the θ direction.

With the present embodiment, the reference ink discharge orifice group employed for adjustment of a recording positional deviation in the θ direction within the ink discharge orifice low has been set to n1 through n4, but the discharge orifices to be employed as the reference ink discharge group are not restricted to these. As illustrated in FIGS. 25, 26, 27, and 28, the reference ink discharge orifice group to be employed for adjustment of a recording positional deviation in the θ direction within the ink discharge orifice row may be the discharge orifices n5 through n8 of any one of the ink discharge orifice rows A, B, C, and D.

Figure 32A:
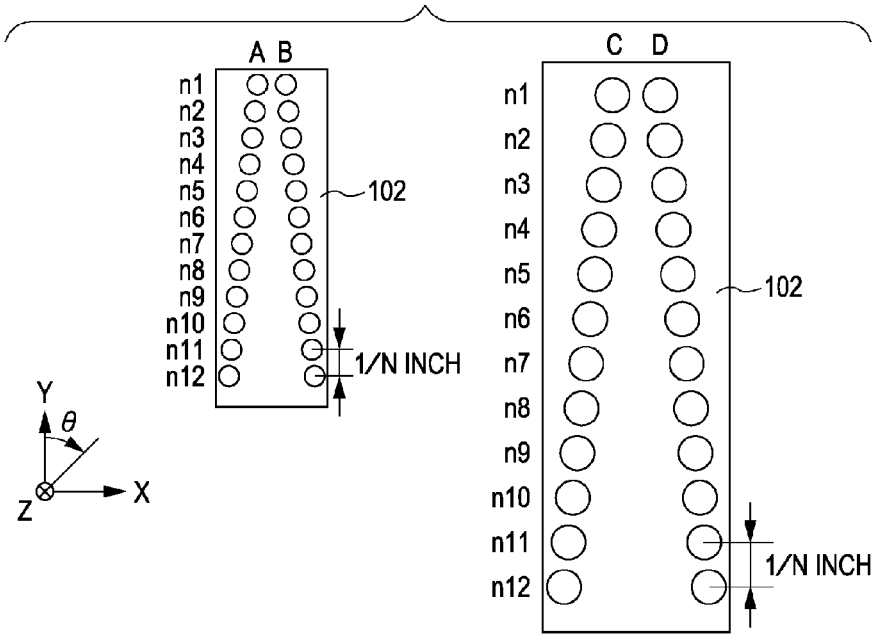
FIG. 32A is a diagram illustrating a case in which the ink discharge orifice interval of two recording heads differs between one head and another head.
Figure 32B:
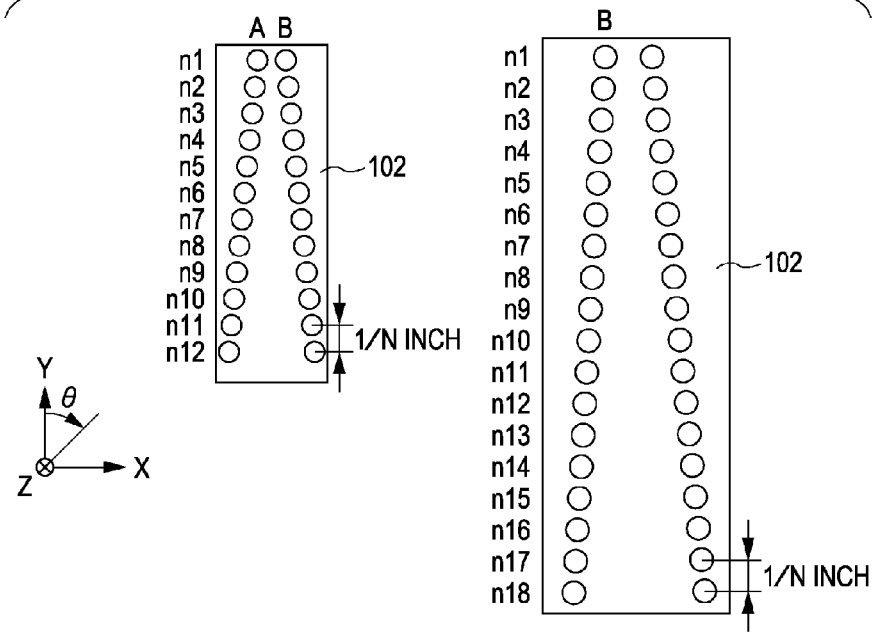
FIG. 32B is a diagram illustrating a case in which the number of ink discharge orifices of two recording heads differs.

The two recording heads employed for the present embodiment have the same number of ink discharge orifices and the same interval of ink discharge orifices. However, the number of ink discharge orifices and the interval of ink discharge orifices are not restricted to this. As illustrated in FIG. 32A, even in the event that the ink discharge orifice intervals of the two recording heads differ, such as 1/600 inch for the ink discharge orifice rows A and B, and 1/300 inch for the ink discharge orifice rows C and D, the reference ink discharge orifice group may be set to the n1 through n4 of the ink discharge orifice row A, the n1 through n4 of the ink discharge orifice row B, the n1 and n2 of the ink discharge orifice row C, and the n1 and n2 of the ink discharge orifice row D. Also, as illustrated in FIG. 32B, even in the event that the number of ink discharge orifices of the two recording heads differs, such as 12 for the ink discharge orifice rows A and B, and 18 for the ink discharge orifice rows C and D, the reference ink discharge orifice group to be employed for adjustment of a recording position deviance in the θ direction within the ink discharge orifice row may be set to the n1 through n4 of the ink discharge orifice rows A and B, and the n1 through n6 of the ink discharge orifice rows C and D.

Figure 20:
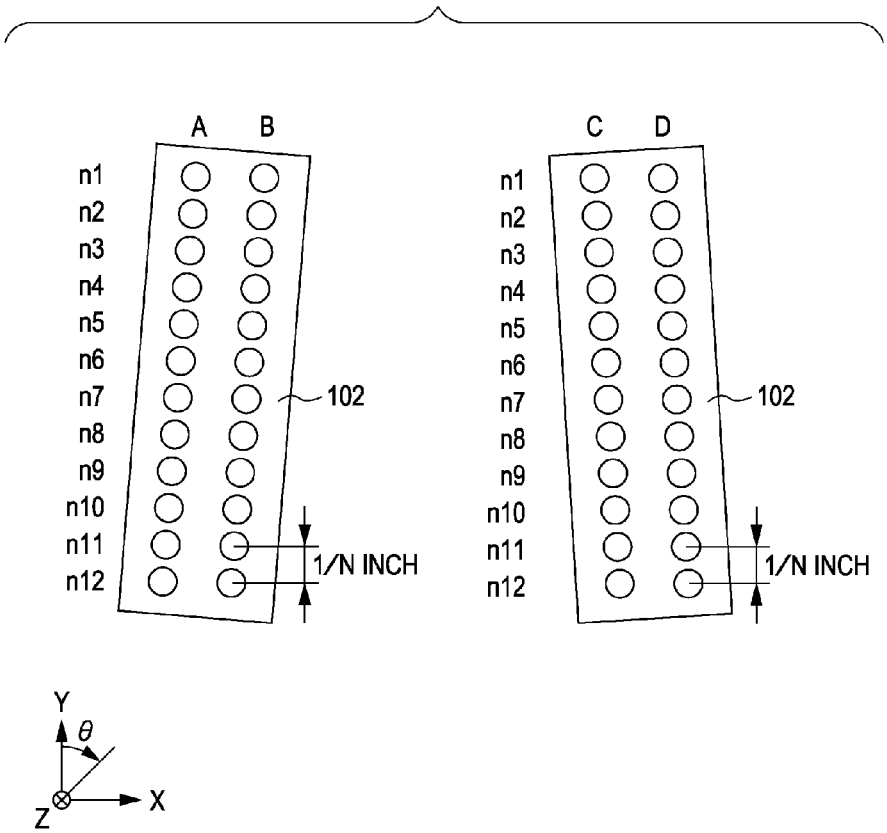
FIG. 20 is a diagram of a recording head leaning in the direction θ due to mounting irregularities to an ink-jet recording device main unit with the second embodiment.

FIG. 20 is a diagram illustrating a state in which the recording head 102 is leaning in the θ direction due to mounting irregularities of the recording head 102 as to the ink-jet recording device main unit. Thus, upon recording to the recording medium being performed in a state in which the recording head 102 is leaning in the θ direction, the recording position deviates. However, the recording dots discharged from the ink discharge orifice rows A and B are impacted upon a recording medium leaning for the same amount in the θ direction, and accordingly, the recording position adjustment values for adjusting a recording positional deviation in the θ direction within the ink discharge orifice row A and within the ink discharge orifice row B become equal. Consequently, the check patterns B for obtaining an adjustment value for adjusting a recording positional deviation within the discharge orifice row B in FIG. 19 employed in the present embodiment can be substituted with the check patterns A. Similarly, the check patterns D for obtaining an adjustment value for adjusting a recording positional deviation within the discharge orifice row D in FIG. 19 employed in the present embodiment can be substituted with the check patterns C. Also, in the event that the ink discharge orifice rows A and B are in the same chip, the distance between the ink discharge orifice rows A and B is uniquely determined, which eliminates necessity of the processing using the check patterns E for obtaining an adjustment value for adjusting a recording positional deviation between the two rows of the ink discharge orifice rows A and B in FIG. 19 employed in the present embodiment. Similarly, in the event that the ink discharge orifice rows C and D are in the same chip, the distance between the ink discharge orifice rows C and D is uniquely determined, which eliminates necessity of the processing using the check patterns G for obtaining an adjustment value for adjusting a recording positional deviation between the two rows of the ink discharge orifice rows C and D in FIG. 19 employed in the present embodiment. Thus, in the event of the same recording positional deviation in the θ direction within the ink discharge orifice rows within the same chip or the same cartridge, a recording position adjustment value may be obtained with a certain ink discharge orifice row serving as the reference (representation), or in the event that the distance between the respective ink discharge orifice rows is uniquely determined, a fixed value may be employed instead of obtaining a recording position adjustment value.

Third Embodiment

With the present embodiment, description will be made regarding a case in which of ink discharge orifices to be employed for adjusting the driving timing between two types of ink discharge orifice rows, at least one type of ink discharge orifice row includes an ink discharge orifice serving as the reference of ink discharge orifice rows.

Figure 36:
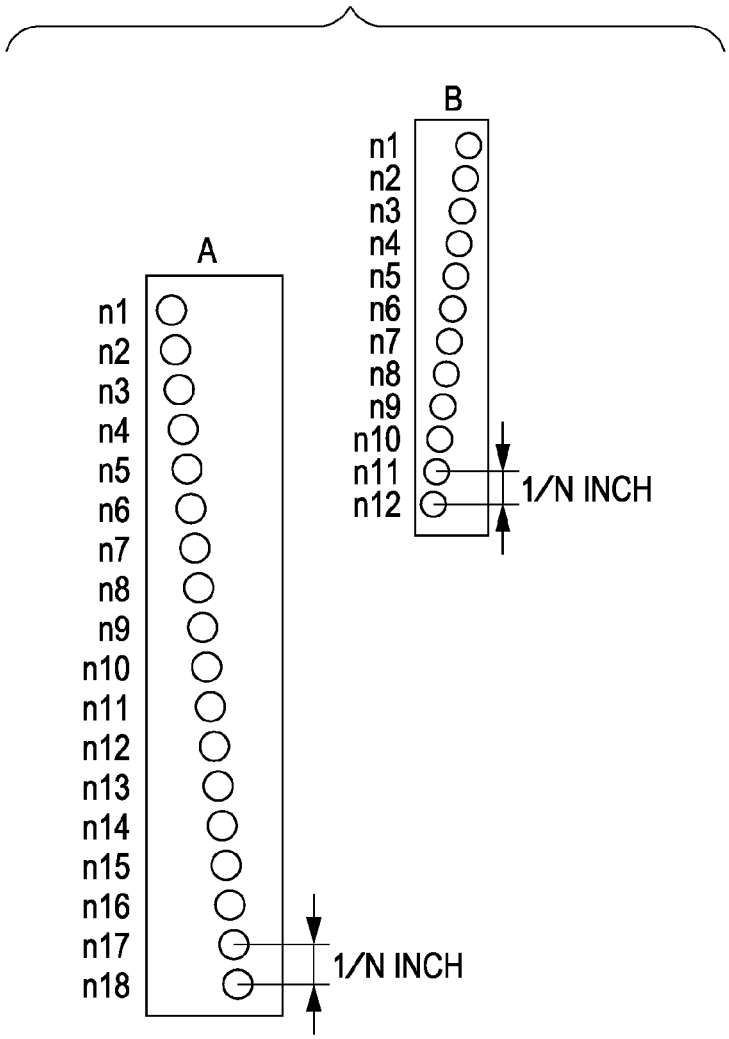
FIG. 36 is a diagram schematically illustrating ink discharge orifice rows in a recording head for describing a third embodiment.

FIG. 36 illustrates recording heads for describing the present embodiment.

The recording heads are made up of a recording head A having a discharge orifice interval of 1/600 inch, and 18 discharge orifices, and a recording head B having a discharge orifice interval of 1/600 inch, and 12 discharge orifices.

Let us say that the ink discharge orifice groups of the recording head A, which are employed for adjustment of a recording positional deviation in the rotational direction θ within an ink discharge orifice row, are three groups of n1 through n6, n7 through n12, and n13 through n18, and an ink discharge orifice group serving as the reference is n1 through n6.

Let us say that the ink discharge orifice groups of the recording head B, which are employed for adjustment of a recording positional deviation in the rotational direction θ within an ink discharge orifice row, are three groups of n1 through n4, n5 through n8, and n9 through n12, and an ink discharge orifice group serving as the reference is n1 through n4.

Also, the ink discharge orifice n1 of the recording head A and the ink discharge orifice n1 of the recording head B are disposed with a deviation of 4/600 inch, which is equivalent to 1/600 inch×four discharge orifices, in the sub-scanning direction for conveying a recording medium.

As for adjustment of a recording positional deviation in the rotational direction θ within the respective ink discharge orifice rows of the recording heads A and B, adjustment is performed by shifting the driving timing of the non-reference ink discharge orifice groups as to the reference ink discharge orifice group in the same way as the above embodiment. As for the method for shifting the driving timing, data may be shifted in the same way as the above embodiment, or timing for applying discharge pulses may be offset.

Next, description will be made regarding adjustment of a recording positional deviation between the respective ink discharge orifice rows of the recording heads A and B. As for the ink discharge orifices to be employed for adjustment of a recording positional deviation between the ink discharge orifice rows, the recording head A employs the eight ink discharge orifices of n1 through n8 including the reference ink discharge orifice group n1 through n6. The recording head B employs the eight ink discharge orifices of n5 through n12 wherein the sub-scanning direction for conveying a recording medium corresponds to the same position as the recording head A.

Figure 37:
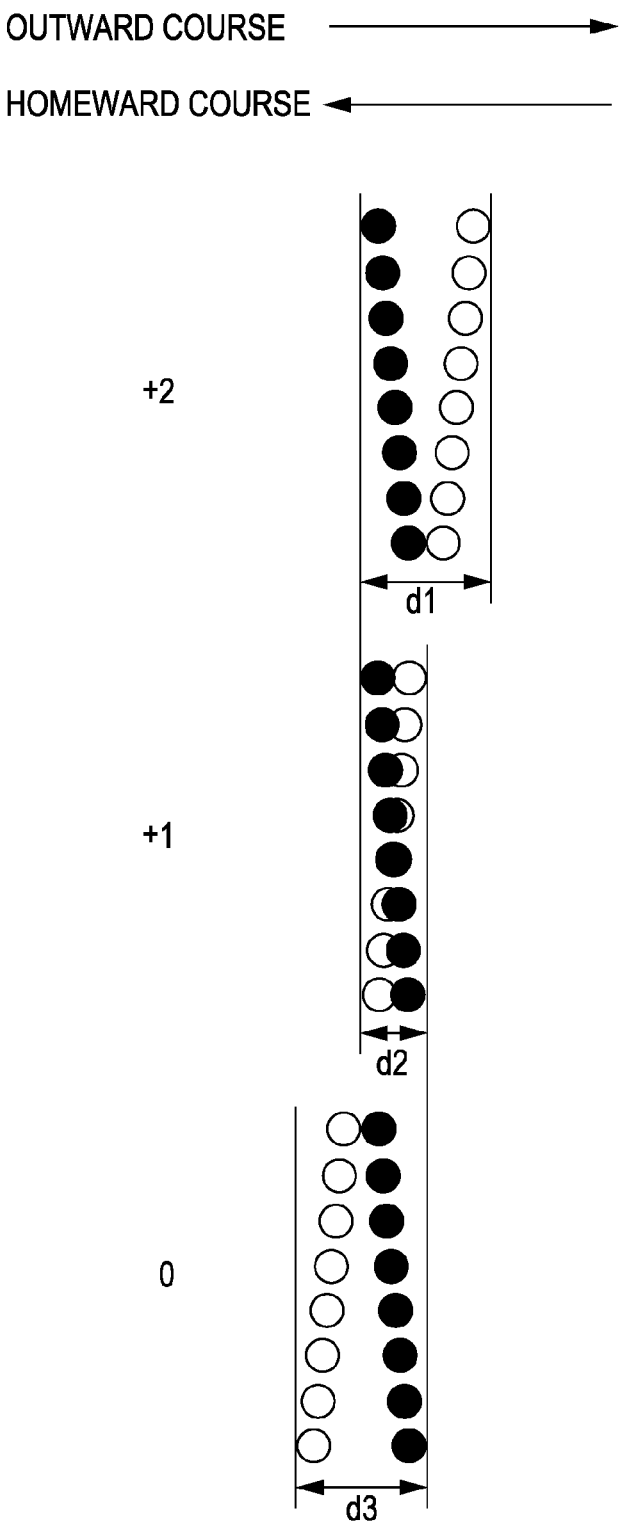
FIG. 37 is a diagram illustrating check patterns for adjusting a recording positional deviation between the ink discharge orifice rows of recording heads A and B according to the third embodiment.

FIG. 37 illustrates check patterns for adjusting a recording positional deviation between the ink discharge orifice rows of recording heads A and B according to the present embodiment. Black circles denote a pattern discharged from the eight ink discharge orifices of n1 through n8 of the recording head A, and white circles denote a pattern discharged from the eight ink discharge orifices of n5 through n12 of the recording head B. Assuming that the black circle pattern discharged from the recording head A is the reference ink discharge orifice row, three types of check patterns will be shown wherein the driving timing for recording the white circle pattern to be discharged from the recording head B is shifted in the outward direction of the main-scanning. Assuming that the adjustment value+1 of the driving timing at the time of recording check patterns in which the width in the scanning direction of the patterns made up of the black circles and white circles is the narrowest width d1 is taken as a recording position adjustment value between the ink discharge orifice rows, this value is stored in a storage region such as the EEPROM of the recording device main unit or the like.

Recording of image data is performed in a state in which adjustment of a recording positional deviation in the rotational direction θ within the respective ink discharge orifice rows of the recording heads A and B (description is the same as that in the above embodiment, and accordingly is omitted), and adjustment of a recording positional deviation between the respective ink discharge orifice rows of the recording heads A and B are performed based on the stored adjustment value+1.

As described above, of the ink discharge orifices to be employed for adjusting a recording positional deviation between at least two types of ink discharge orifice rows of the recording heads A and B, at least any one type (recording head A) of ink discharge orifice row includes the ink discharge orifices serving as the reference to be employed for adjusting a recording positional deviation in the rotational direction θ within the ink discharge orifice row, thereby providing the same advantage as the above embodiment. In other words, the amount of deviation between the ink discharge orifice rows can be reduced in a state in which the deviation of a recording position in the rotational direction θ within the ink discharge orifice row is adjusted.

Further, with a configuration wherein the ink discharge position serving as the reference to be employed for adjusting the deviation of a recording position in the rotational direction θ within the ink discharge orifice row includes at least different two types of ink discharge orifice rows in the sub-scanning direction for conveying a recording medium, assuming that the ink discharge orifice position serving to be employed for adjusting the deviation of a recording position between the ink discharge orifice rows is positioned at the same position in the sub-scanning direction for conveying a recording medium, whereby the check patterns of each of the ink discharge orifice rows can be recorded at the same recording scanning, and accordingly, the deviation of a recording position due to transportation irregularities at the time of conveying a recording medium can be prevented from occurrence. Also, the check patterns of each of the ink discharge orifice rows can be recorded at the same recording scanning, whereby time necessary for recording the check patterns for obtaining an adjustment value for adjusting the deviation of a recording position can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An ink-jet recording device comprising:

a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction; and a pattern record controlling unit configured to have the recording unit record a first pattern relating to adjustment of a relative recording position on a recording medium in the scanning direction between a discharge orifice in one part of the first discharge orifice row and a discharge orifice in another part of the first discharge orifice row, using the one part of the first discharge orifice row and the another part of the first discharge orifice row, a second pattern relating to adjustment of a relative recording position on a recording medium in the scanning direction between a discharge orifice in one part of the second discharge orifice row and a discharge orifice in another part of the second discharge orifice row, using the one part of the second discharge orifice row and the another part of the second discharge orifice row, and a third pattern relating to adjustment of a relative recording position on a recording medium between the discharge orifice in the one part of the first discharge orifice row and the discharge orifice in the one part of the second discharge orifice row in the scanning direction, using the one part of the first discharge orifice row and the one part of the second discharge orifice row, and without using the another part of the first discharge orifice row and the another part of the second discharge orifice row.

2. The ink-jet recording device according to claim 1, wherein the first discharge orifice row and the second discharge orifice row are arranged side by side in the scanning direction.

3. The ink-jet recording device according to claim 1, wherein a color of ink discharged by the first discharge orifice row is different from a color of ink discharged by the second discharge orifice row.

4. The ink-jet recording device according to claim 1, wherein the pattern record controlling unit has the recording unit record the first pattern, the second pattern and the third pattern on one sheet of the recording medium.

5. An ink-jet recording method for recording an image on a recording medium using a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction, the ink-jet recording method comprising:

causing the recording unit to record a first pattern relating to adjustment of a relative recording position on a recording medium in the scanning direction between a discharge orifice in one part of the first discharge orifice row and a discharge orifice in another part of the first discharge orifice row, using the one part of the first discharge orifice row and the another part of the first discharge orifice row, a second pattern relating to adjustment of a relative recording position on a recording medium in the scanning direction between a discharge orifice in one part of the second discharge orifice row and a discharge orifice in another part of the second discharge orifice row, using the one part of the second discharge orifice row and the another part of the second discharge orifice row, and a third pattern relating to adjustment of a relative recording position on a recording medium between the discharge orifice in the one part of the first discharge orifice row and the discharge orifice in the one part of the second discharge orifice row in the scanning direction, using the one part of the first discharge orifice row and the one part of the second discharge orifice row, and without using the another part of the first discharge orifice row and the another part of the second discharge orifice row.

6. An ink-jet recording device comprising:

a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction; and a pattern record controlling unit configured to have the recording unit record a first pattern relating to first adjustment of a relative recording position on a print medium in the scanning direction between a predetermined discharge orifice and another discharge orifice of the first discharge orifice row, wherein the recording position of the predetermined discharge orifice of the first discharge orifice row is used as a reference in the first adjustment, a second pattern relating to second adjustment of a relative recording position on a print medium in the scanning direction between a predetermined discharge orifice and another discharge orifice of the second discharge orifice row, wherein the recording position of the ink discharge from the predetermined discharge orifice of the second discharge orifice row is used as a reference in the second adjustment, and a third pattern relating to second adjustment of a relative recording position on a print medium in the scanning direction between the predetermined discharge orifice of the first discharge orifice row and the predetermined discharge orifice of the second discharge orifice row, wherein the recording position of the predetermined discharge orifice of the first discharge orifice row and the recording position of the predetermined discharge orifice of the second discharge orifice row are used as references respectively in the third adjustment.

7. The ink-jet recording device according to claim 6, wherein the first discharge orifice row and the second discharge orifice row are arranged side by side in the scanning direction.

8. The ink-jet recording device according to claim 6, wherein the recording unit comprises a plurality of recording heads and each of the first discharge orifice row and the second discharge orifice row are provided in different recording heads.

9. An ink-jet recording method for recording an image on a recording medium using a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction, the ink-jet recording method comprising:

causing the recording unit to record a first pattern relating to first adjustment of a relative recording position on a print medium in the scanning direction between a predetermined discharge orifice and another discharge orifice of the first discharge orifice row, wherein the recording position of the predetermined discharge orifice of the first discharge orifice row is used as a reference in the first adjustment, a second pattern relating to second adjustment of a relative recording position on a print medium in the scanning direction between a predetermined discharge orifice and another discharge orifice of the second discharge orifice row, wherein the recording position of the ink discharge from the predetermined discharge orifice of the second discharge orifice row is used as a reference in the second adjustment, and a third pattern relating to second adjustment of a relative recording position on a print medium in the scanning direction between the predetermined discharge orifice of the first discharge orifice row and the predetermined discharge orifice of the second discharge orifice row, wherein the recording position of the predetermined discharge orifice of the first discharge orifice row and the recording position of the predetermined discharge orifice of the second discharge orifice row are used as references respectively in the third adjustment.

10. An ink-jet recording device comprising:

a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction;

a pattern record controlling unit configured to have the recording unit record a first pattern relating to first adjustment of a first relative recording position on a recording medium in the scanning direction between a discharge orifice in one part of the first discharge orifice row and a discharge orifice in another part of the first discharge orifice row, using the one part of the first discharge orifice row and the another part of the first discharge orifice row, a second pattern relating to second adjustment of a second relative recording position on a recording medium in the scanning direction between a discharge orifice in one part of the second discharge orifice row and a discharge orifice in another part of the second discharge orifice row, using the one part of the second discharge orifice row and the another part of the second discharge orifice row, and a third pattern relating to third adjustment of a third relative recording position on a recording medium between the discharge orifice in the one part of the first discharge orifice row and the discharge orifice in the one part of the second discharge orifice row in the scanning direction, using the one part of the first discharge orifice row and the one part of the second discharge orifice row, and without using the another part of the first discharge orifice row and the another part of the second discharge orifice row; and an adjusting unit configured to execute the first adjustment based on information about degree of deviation of the first relative recording position obtained by the first pattern, the second adjustment based on information about degree of deviation of the second relative recording position obtained by the second pattern, and the third adjustment based on information about degree of deviation of the third relative recording position obtained by the third pattern, for a recording by the recording unit on a print medium.

11. The ink-jet recording device according to claim 10, wherein the first discharge orifice row and the second discharge orifice row are arranged side by side in the scanning direction.

12. The ink-jet recording device according to claim 10, wherein the recording unit comprises a plurality of recording heads and each of the first discharge orifice row and the second discharge orifice row are provided in different recording heads.

13. The ink-jet recording device according to claim 10, wherein the adjusting unit adjusts the first, second and third relative recording positions by offsetting recording data used by the recording unit for recording the image in the scanning direction.

14. The ink-jet recording device according to claim 10, wherein the adjusting unit adjusts a timing of applying discharge pulses used for discharging ink from the first discharge orifice row and the second discharge orifice row.

15. The ink-jet recording device according to claim 10, wherein a color of ink discharged by the first discharge orifice row is different from a color of ink discharged by the second discharge orifice row.

16. The ink-jet recording device according to claim 10, further comprising a sensor configured to optically measure the first, the second and the third patterns, wherein the adjusting unit adjusts the first, the second and the third relative recording positions based on a result of measurement of the first, the second and the third patterns by the sensor.

17. The ink-jet recording device according to claim 10, wherein the adjusting unit adjusts the first, the second and the third relative recording positions based on an input by a user of information relating to the first, the second and the third pattern.

18. The ink-jet recording device according to claim 10, wherein the pattern record controlling unit has the recording unit record the first pattern, the second pattern and the third pattern on one sheet of the recording medium.

19. An ink-jet recording method for recording an image on a recording medium using a recording unit configured to record an image on a recording medium including a first discharge orifice row and a second discharge orifice row formed by a plurality of discharge orifices for discharging ink arranged in a predetermined direction, by discharging ink from discharge orifices of the first discharge orifice row and the second discharge orifice row with relative scan between the recording unit and the recording medium in a scanning direction intersecting with the predetermined direction, the ink-jet recording method comprising:

causing the recording unit to record a first pattern relating to first adjustment of a first relative recording position on a recording medium in the scanning direction between a discharge orifice in one part of the first discharge orifice row and a discharge orifice in another part of the first discharge orifice row, using the one part of the first discharge orifice row and the another part of the first discharge orifice row, a second pattern relating to second adjustment of a second relative recording position on a recording medium in the scanning direction between a discharge orifice in one part of the second discharge orifice row and a discharge orifice in another part of the second discharge orifice row, using the one part of the second discharge orifice row and the another part of the second discharge orifice row, and a third pattern relating to third adjustment of a third relative recording position on a recording medium between the discharge orifice in the one part of the first discharge orifice row and the discharge orifice in the one part of the second discharge orifice row in the scanning direction, using the one part of the first discharge orifice row and the one part of the second discharge orifice row, and without using the another part of the first discharge orifice row and the another part of the second discharge orifice row; and executing the first adjustment based on information about degree of deviation of the first relative recording position obtained by the first pattern, the second adjustment based on information about degree of deviation of the second relative recording position obtained by the second pattern, and the third adjustment based on information about degree of deviation of the third relative recording position obtained by the third pattern, for a recording by the recording unit on a print medium.

* * * * *